US005526609A

United States Patent [19]

Lee et al.

[11] Patent Number: 5,526,609

[45] Date of Patent: Jun. 18, 1996

[54] METHOD AND APPARATUS FOR REAL-TIME STRUCTURE PARAMETER MODIFICATION

[75] Inventors: George C. Lee; Zhong Liang; Mai Tong, all of Buffalo, N.Y.

[73] Assignee: Research Foundation of State University of New York, Buffalo, N.Y.

[21] Appl. No.: 344,169

[22] Filed: Nov. 23, 1994

Related U.S. Application Data

[63] Continuation-in-part of Ser. No. 189,181, Jan. 28, 1994.

[51] Int. Cl.[6] ..... E04H 9/00

[52] U.S. Cl. ..... 52/1; 52/167.2

[58] Field of Search ..... 52/1, 167.2, 167.1

[56] References Cited

PUBLICATIONS

M. Hubbard & D. Margolis (1976) "The Semi–Active Spring: Is it Viable Suspension Concept?" Proceedings of the Fourth Intersociety Conference on Transpostation.

D. Margolis & D. Baker (1992) "The variable Fulcrum Isolator: A Low Power, Non–Linear, Vibration Control Component" Transactions of the ASME, vol. 114, pp. 148–154.

E. Krasnicki (1980) "Comparison of Analytical and Experimental Results For a Semi–Active Vibration Isolator" The Shock and Viration Bulletin.

D. Ivers & L. Miller (1992) "Semi–Active Suspension Technology: An Evolutionary View" ASME DE–vol. 40, Advanced Automotive Technologies.

*Primary Examiner*—Creighton Smith

*Attorney, Agent, or Firm*—John C. Thompson

[57] ABSTRACT

A method and apparatus for structural deflection control, as well as associated sequential controls that are based on new control laws. The apparatus of this invention is of relatively low cost and performs better than prior art devices. The essence of the invention is to adjust the dynamic parameters (mass, damping, stiffness coefficients of the structure and/or input forcing coefficients) adaptive to input dynamic loads, by using the new devices and the suggested control laws. In so doing, the structure performs an adaptive function to effectively counter the effects induced by multi-directional external excitations. The required control power can be nil, or many times lower than prior art active control devices, and the effectiveness can be equivalent or even better than the current state-of-the-art active controls. The devices used by the apparatus of this invention can readily be manufactured for immediate application in structures, buildings and contents, and other constructed facilities.

10 Claims, 15 Drawing Sheets

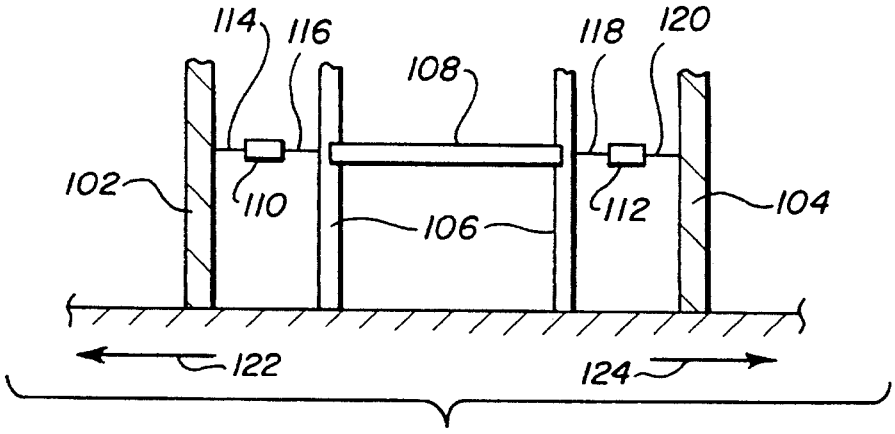
FIG-22
FIG-23
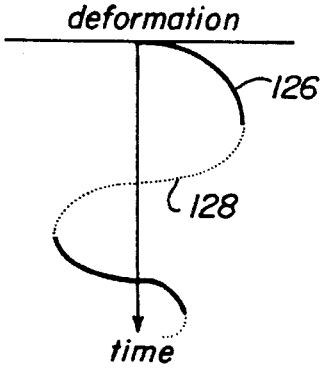
FIG-24
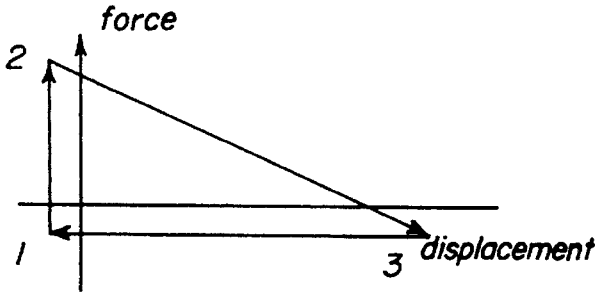
FIG-25
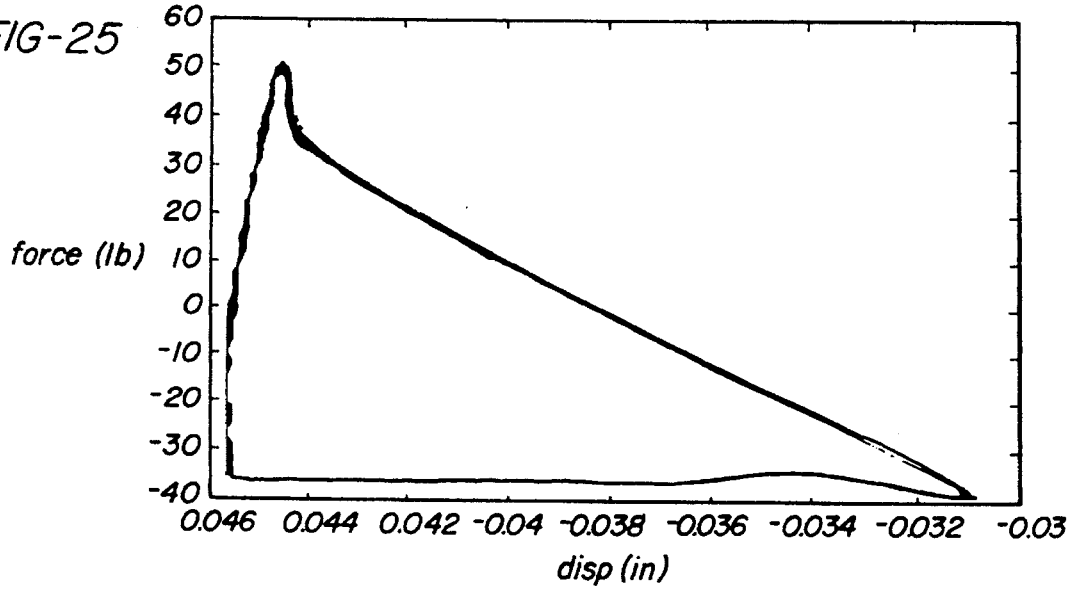

METHOD AND APPARATUS FOR REAL-TIME STRUCTURE PARAMETER MODIFICATION

This application is a continuation-in-part application of U.S. application Ser. No. 08/189,181 filed Jan. 28, 1994, from which applicants claim priority.

TECHNICAL FIELD

The present invention relates generally to a method and apparatus for controlling the displacement (or vibration) of a structure when subjected to external forces such as an earthquake or wind, the apparatus employing novel damping/coupling devices and mounts therefor; and more particularly to a method and apparatus to adjust the dynamic parameters (mass, damping, stiffness coefficients) of a structure by using new devices mounted in novel manners in accordance with novel processes developed from newly proposed control laws.

BACKGROUND OF THE INVENTION

It is well known that structures can fail when subjected to external forces of sufficient magnitude, as for example high winds or a moderate to strong earthquake. Many proposals have been made for improving the ability of a structure to withstand such forces without damage or failure of the structure. The approaches range from making the structure rigid, making it flexible, to mounting the structure upon the surface of the ground so that it can move relative to the ground, by coupling or uncoupling the structure to a mass to change its resonant frequencies, etc. One such example is shown in U.S. Pat. No. 5,036,633 invented by Kobori wherein an apparatus is disclosed for controlling the response of a structure to external forces such as seismic vibration and/or wind impacting against the structure, the control apparatus including variable stiffness means secured to and bracing the structure, variable damping means interposed between the structure and the variable stiffness means, and a computer which is programmed to monitor external forces impacting against the structure and to control the variable damping means by selecting a coefficient of damping suitable to render the structure non-resonant relative to the monitored external forces. The foregoing patent of Kobori, as well as other patents of Kobori, and patents of others, are based on feedback control principles which include changing stiffness to avoid resonance according to ground motion forecasting, changing damping coefficient according to preset damping standards, and varying the stiffness of a local member by locking or unlocking a device disposed between the ends of a member. The approach of the prior art emphasizes identifying individual structural vibration-reduction-devices, but does not perform an analysis of the whole structural system's behavior. Furthermore, the prior art analysis tends to focus on a single plane of the structure and the analysis is not three dimensional.

SUMMARY AND OBJECTS OF THE INVENTION

The major concept of the present invention is to provide a method and apparatus for controlling a structure to minimize time-varying motion of the structure by a real-time modification of structure parameters to achieve a cost-effective control of structural deformation, internal force, buckling, destructive energy and related damages caused by multi-directional loading such as earthquake, winds, traffic, and/or other type of ambient loading. The control is based upon the use of control devices in accordance with control principles which are non-linear, time dependent, and adaptive; the control devices making the system more robust, and hence more stable. Since this approach actually controls the physical parameters of the structure through adaptive control devices, it is called functional adaptive control, and a structure which is capable of modifying its dynamic performance is called an adaptive structure.

The present invention contemplates changing within an adaptive structure the coefficients of the displacement, velocity and acceleration, namely the stiffness, damping, and mass. In addition, the present invention may also change certain coefficients of the input driving forces. For example, it may change the friction coefficients of base-isolation devices for structures to minimize the input force/energy for ground motion. Since the new approach actually controls the physical parameters of the structures, it therefore controls the characteristics or the functional behavior of the structure through the adaptive devices.

The underlying theory of the present invention is based upon analysis of the whole structural system's behavior, and therefore is innervative (adaptive), and is characterized by the following:

1) Control procedure—System's optimal approach by changing the physical parameters of the structure such as damping, and either mass or stiffness, or both.
2) Control mechanism—Through coupling/uncoupling of certain substructures and/or sub-members by means of functional switches.
3) Control Principle—Minimization of conservative energy through the use of a computer program which will perform a sequence of steps arranged in a hierarchical fashion.

In addition, in the preferred embodiment no actuators apply force to the structure. Therefore, the control is not active.

Each of the functional switches of the control mechanism can be in one of the following states: "on", "off" or "damp". By varying the state of each functional switch, the switches may control the physical parameters of an associated structure such as mass, damping, and stiffness, and the functional switches may also control the input-driving forces.

When a functional switch is "on" portions of the switch are rigidly connected to each other and the switch can connect a heavy mass to add significant mass to the structure. Also, when a functional switch is "on" it can connect members of the structure to increase the stiffness of the structure to reduce the corresponding displacement and thereby increase the natural frequency of the structure. When a switch is "off" the connections are eliminated, thus the opposed portions of the switch are freely movable with respect to each other. When a switch is set at "damp", there is a viscous movement of the opposed portions and the switch can also increase the energy dissipation capacity of the structure. When this state is eliminated, the damping force can be significantly reduced, which may therefore reduce the input driving forces.

Since there are only three output states of a functional switch, the control processes for the operation of the switches can be relatively simple. Thus the calculating speed will be increased significantly, which is a key issue in active or adaptive control.

To better understand the control theory of this invention, a prior art active control system will be considered first. For a linear mechanical vibration system, the following equation may be used to describe its motion:

$$f(t)=MX''(t)+CX'(t)+KX(t) \quad (1)$$

where f is the external force, M, C, and K are the mass, damping and stiffness coefficient matrices, X(t), X'(t), and X"(t) are the displacement, velocity and acceleration vectors, and the superscripts ' and " stand for the first and second derivatives with respect to time. In a single degree of freedom (hereinafter SDOF) system, in equation (1), the work done by the internal force MX" can be described as the kinetic energy. The work done by the damping force CX' can be described as dissipated energy. The work done by the spring force KX can be described as the potential energy. The sum of these three energy terms equals the work done by the external force f. This can be stated as:

$$E_c=E_i-E_d\pm E_t \quad (2)$$

where E stands for energy, and the subscripts c, i, d, and t stand for conservative, input, damping, and transfer energy, respectively. (For a pure SDOF system, $E_t=0$. However, if equation (1) is used to describe a vibrational mode of a multi-degree-of-freedom (hereinafter MDOF) structure, $E_t$ exists either positively or negatively.) When the mass, damping and stiffness coefficients are fixed, both the kinetic and the potential energy are conservative. Only the damping force dissipates energy.

If the coefficients M, C, K can be changed as they are in real-time structural parameter modification (hereinafter RSM) devices of this invention, neither the kinetic nor the potential energy are completely conservative. Thus equation (1) can be rewritten as follows:

$$M(t)X''(t)+C(t)X'(t)+K(t)X(t)=F(t) \quad (3)$$

Comparing equation (3) with equation (1) it is apparent that all parameters have become functions of time. A certain amount of energy may be transferred outside the structure by functional switches. The remaining energy is still conservative. It is intuitive that, to minimize the displacement of the structure, the conservative part of the kinetic and potential energy should be minimized. If the conservative energy is minimized, the displacement keeps the smallest value. This is the essence of the principle of minimal conservative energy. Thus:

$$E_{kc}+E_{pc}=minimized \quad (4)$$

The energy equation of the entire system can be written as:

$$W=E_{kc}+E_{kf}+E_d+E_{df}+E_{pc}+E_{pf} \quad (5)$$

Here, the letter W is the work done by the external forces, and the letter E stands for energy terms. The subscript k stand for kinetic, d for energy to be dissipated by damping force, p means potential, and c means conservative energy. The second subscript f stands for the energy transferred and is dropped later by the functional switches. To minimize the $E_{pc}+E_{kc}$ from the above equation, it can be seen that an optimal result can be achieved by maximizing $E_{kf}$, $E_d$, $E_{df}$, and $E_{pf}$ and by minimizing W. Thus minimal $E_{pc}$ is achieved by increasing the energy transfer $E_{kf}$ and $E_{pf}$, increasing the energy dissipation $E_d$ and $E_{df}$, and also by decreasing the work done by the external force W, which is equally important and is achieved by increasing the instantaneous impedance or the entire structure.

While several SDOF systems may be used to approximate a MDOF structure, in a multiple degree of freedom system (MDOF), minimization of Conservative energy becomes a somewhat more complex task. The complexity arises because the energy transfer between the various modes of vibration of a structure must be considered. The energy transfer among modes of a MDOF structure may be determined through the Complex Energy Theory as proposed by Liang and Lee ("Damping of Structures: Part I: Theory of Complex Damping", NCEER Report 91-0004, 1991).

Under the Complex Energy Theory, systems may be classified as proportionally damped or nonproportionally damped. A proportionally damped system is one in which the damping coefficient may be represented as a proportion of mass and stiffness, that is, $$C=(A)M+(B)K \quad (6)$$

where A and B are constant coefficients, and M and K represent the mass and stiffness matrices of a system respectively. A fundamental characteristic of such a system is that there is no energy transfer between modes during vibration.

However, for a nonproportionally damped system, Equation (6) will not hold. This is of particular relevance to the instant invention because as the stiffness, mass and damping matrices of the structure are modified with time, Equation (6) will not be satisfied, and the system will be classified as nonproportionally damped. Accordingly, energy transfer will occur between modes.

The measure of energy transfer between modes may be expressed by a Modal Energy Transfer Ratio $S_i$, where $$S_i=W_{Ti}/4\pi W_i \quad (7)$$

and $W_{Ti}$=Energy transferred to the $i^{th}$ mode during one cycle of vibration and $W_i$=Energy stored in the $i^{th}$ mode before the cycle of vibration.

The natural frequency for any given mode in a nonproportionally damped system is also dependent on the transfer of modal energy. The natural frequency, $w_i$, of the $i^{th}$ mode in a nonproportionally damped system accordingly becomes $$w_i=w_{ni}exp(S_i) \quad (8)$$

where $S_i$ is defined by Equation (7) and $w_{ni}$=the natural frequency of the $i^{th}$ mode if the system was proportionally damped.

In order to minimize conservative energy, it is necessary to minimize the modal energy transfer ratio of Equation (7) for each mode of the structure. This concept will be incorporated into Equation (5) in the Detailed Description section of this application.

From the above it can be seen that one of the objects of the present invention is to provide a design procedure to analyze what kind of real-time structural modification system is needed for the structural control (according to the bare dynamic behavior of the structure), namely what parameters should be modified; to calculate by a novel formula the preliminary design parameters, namely how much the amount of mass, damping and stiffness are needed to be varied; and to check the safety factor of the real-time structural modification.

It is an further object of the present invention to provide a method and apparatus for real-time structural modification of a structure based upon an analysis of the whole structural system's behavior.

It is yet another object of the present invention to provide a novel and more effective energy dissipation control method according to the energy minimization principle.

It is yet another object of the present invention to provide a variational complementary system to realize the aforementioned control method by means of push-pull dual energy dissipation and accommodation devices.

It is yet another object of the present invention to provide innervatively activated hydraulic devices to activate the proper control actions.

It is yet another object of the present invention to provide a novel setup of device and structure coupling/uncoupling to achieve the structural control effect by means of varying structural stiffness-damping parameters or mass-damping stiffness simultaneously to realize the optimal structural physical parameter modification.

It is yet another object of the present invention to provide a computer program which will perform an arranged sequence of steps to treat a MDOF structure subjected to multi-directional input according to the energy minimization principle.

It is yet another object of the present invention to provide a hierarchical process which performs initial local structural control based on velocity and force criteria, a higher level global structural control based on an optimization criteria, and overall override control in the event of control system malfunction.

It is yet another object of the present invention to provide a novel device capable of handling two directional input/output to carry out the command required by the aforementioned logic.

It is yet another object of the present invention to provide a method for controlling the displacement or resonance of a structure by providing energy dissipation devices in non-parallel planes within the structure, by determining the displacement excitations applied to the structure in non-parallel planes, and by controlling the energy dissipation devices in real-time in response to the determined displacement excitations to dissipate energy and control displacement or resonance of the structure.

It is yet another object of the present invention to provide paired energy dissipation devices in a structure, one of the energy dissipation devices being in an "on" stage and the other being in an "off" stage when the structure is subject to movement in a first direction, and the one energy dissipation device being in an "off" stage and the other being in an "on" stage when the structure is subject to movement in an opposite direction.

It is yet another object of the present invention to provide novel control means for controlling paired energy dissipation devices.

It is yet another object of the present invention to provide a novel energy dissipation device.

It is still a further object of the present invention to provide a novel device which can be utilized to couple or uncouple mass into the structure.

It is yet another object of the present invention to provide a novel coupling device which can be used to vary the stiffness of a structure.

The foregoing objects and other objects and advantages of the present invention, as well as the application of the control theory briefly outlined above, will become more apparent to those skilled in the art after a consideration of the following detailed description taken in conjunction with the accompanying drawings.

BRIEF DESCRIPTION OF THE DRAWINGS

FIG. 22 shows yet another application of this invention to a building structure.

FIG. 23 is a diagram showing the results of applying the RSM system to the building Shown in FIG. 22.

FIGS. 24 and 25 show the theoretical and experimental dynamic responses of a prototype switch under certain excitations.

DETAILED DESCRIPTION

Figure 1:
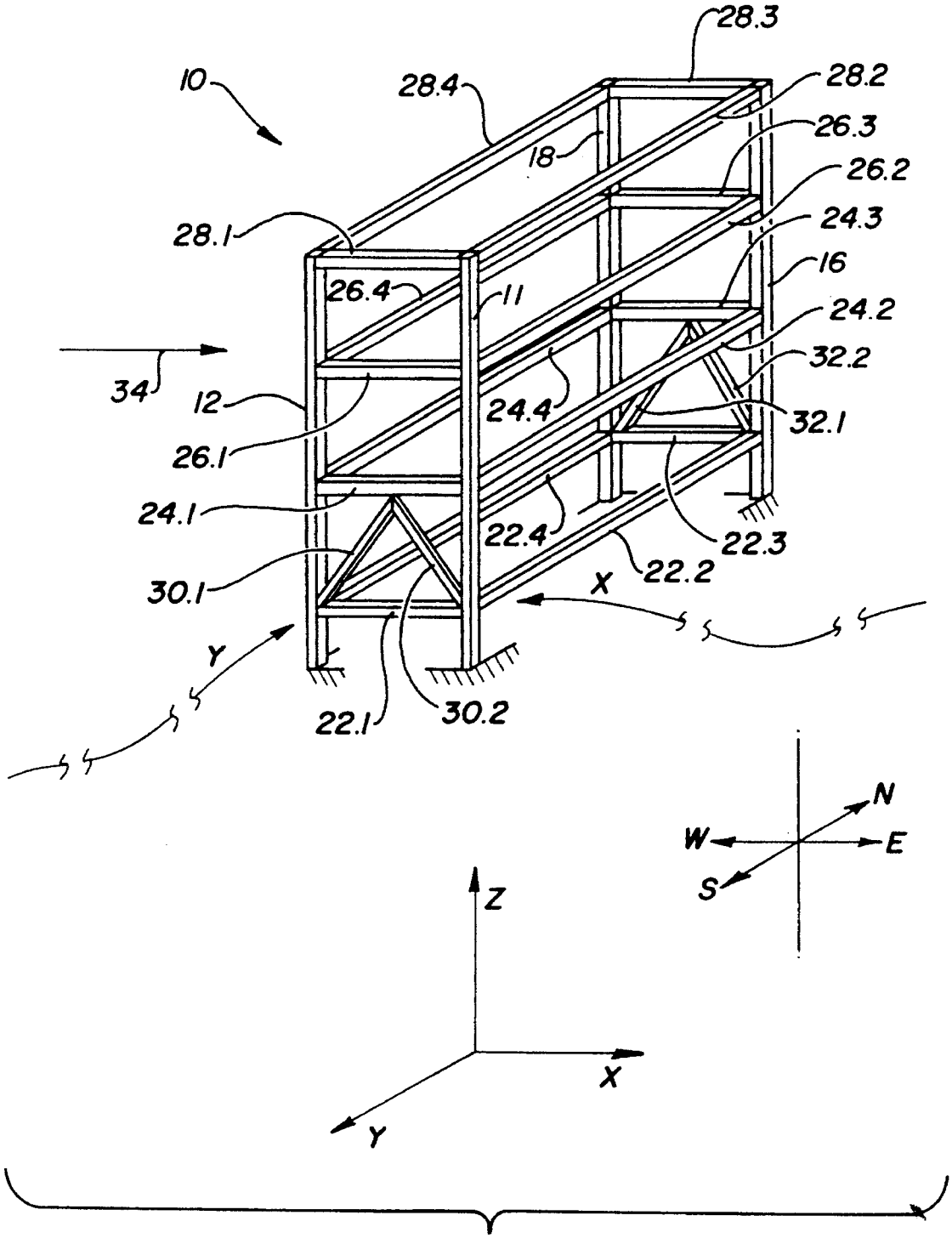
FIG. 1 illustrates a building structure which may be deflected by an earthquake, strong winds, etc.

First, with reference to FIG. 1, a building structure is indicated generally at 10. The structure illustrated has four generally vertically extending columns 12, 14, 16, and 18. In addition, there are a number of floors formed by horizontal beams 20, 22, 24, and 26. As indicated in this figure, the horizontal beams 22.1, 22.3, 24.1, 24.3, etc., extend in an east-west direction in an X-Z plane; and the beams 22.2, 22.4, 24.2, 24.4, etc., extend in a north-south direction in a Y-Z plane. The structure as shown is provided with a passive control such as the chevron bracing beams 30, 32. When the building 10 is subjected to a wind such as a westerly wind indicated by the arrow 34, the building will deflect towards the east. The wind will input energy into the building, the additional energy being stored within the bending columns, etc. When the velocity of the wind 34 decreases, this energy will be released to restore the building to its normal shape. As can be seen from the structure sketched in FIG. 1, all of the deformation to the building occurs in the X-Z plane, which deformation can be resisted by the chevron bracing beams 30, 32.

Figure 2:
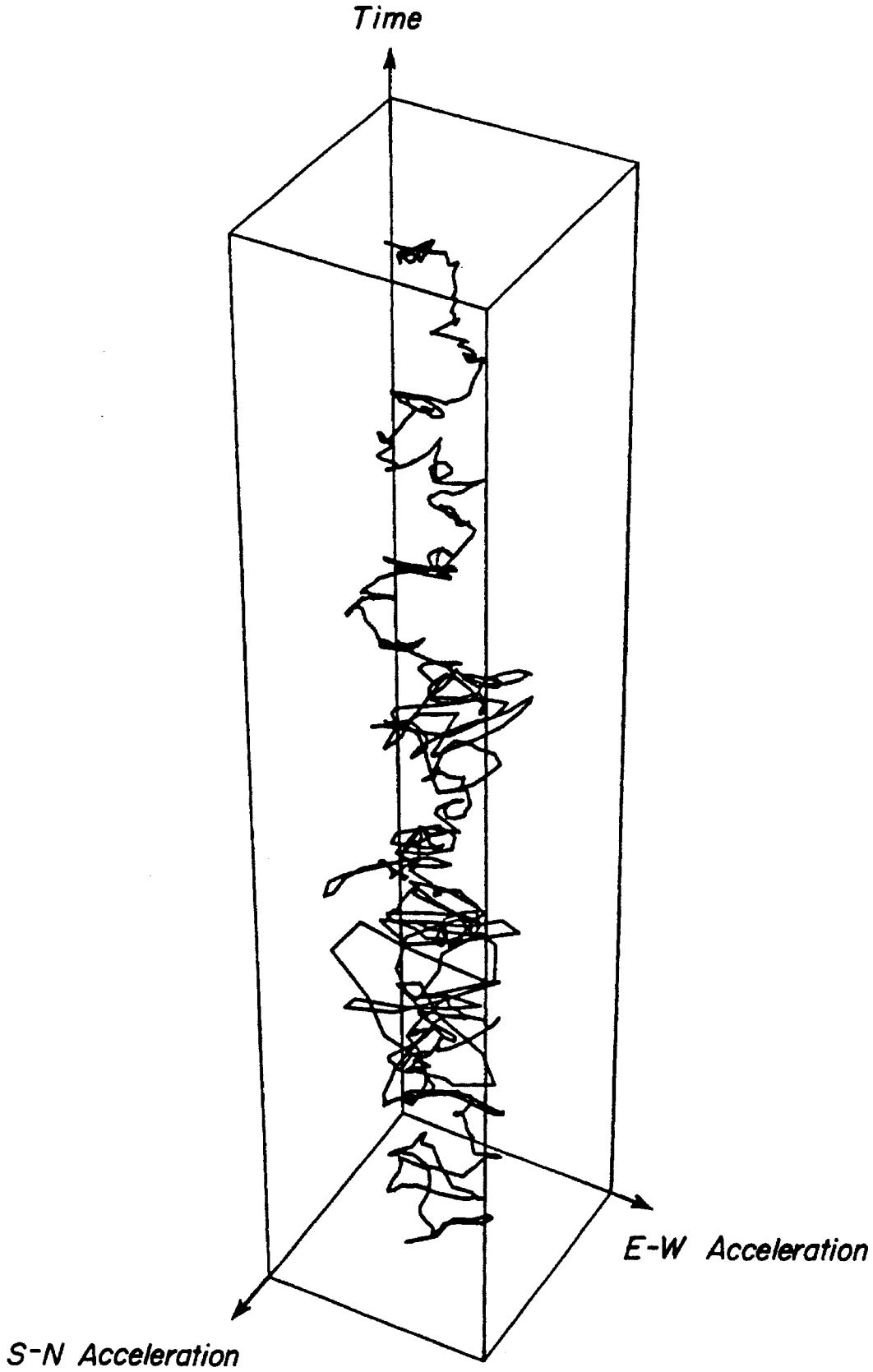
FIG. 2 illustrates the X-Y movement of an earthquake over a period of time.

When the building 10 is subjected to an earthquake, there will be horizontal movement of the ground in X and Y directions (which may be east-west, and north-south, respectively). In addition, there will be ground waves which are indicated by the sinusoidal waves X and Z in FIG. 1. Because of these motions, during an earthquake the building will be subjected to at least five degrees of movement; namely, movement in the X-Y-Z directions, and rotational movement about the X and Y axes, and perhaps rotational movement about the Z axis. In most earthquakes, the excitation and most other dynamic loadings are typically random. This can best be seen from FIG. 2 which is the El Centro Earthquake Response Time History. The building 10, when subjected to such an earthquake, will be deflected and tends to vibrate. The vibration of such a building tends to be destructive.

It has been determined by computer analysis and experimental tests that if the structural physical parameters are modified in real-time that the adaptive structure can withstand a large range vibration magnitudes. Such structural parameter modification may be achieved through the use of functional switches. While many forms of functional switches may be employed, the preferred form is a type which is both bidirectional and which may be used again and again. The functional switch may be set to "off", "on", or "damp" states. Depending upon the application, either a bidirectional or a unidirectional switch may be preferred.

Figure 3:
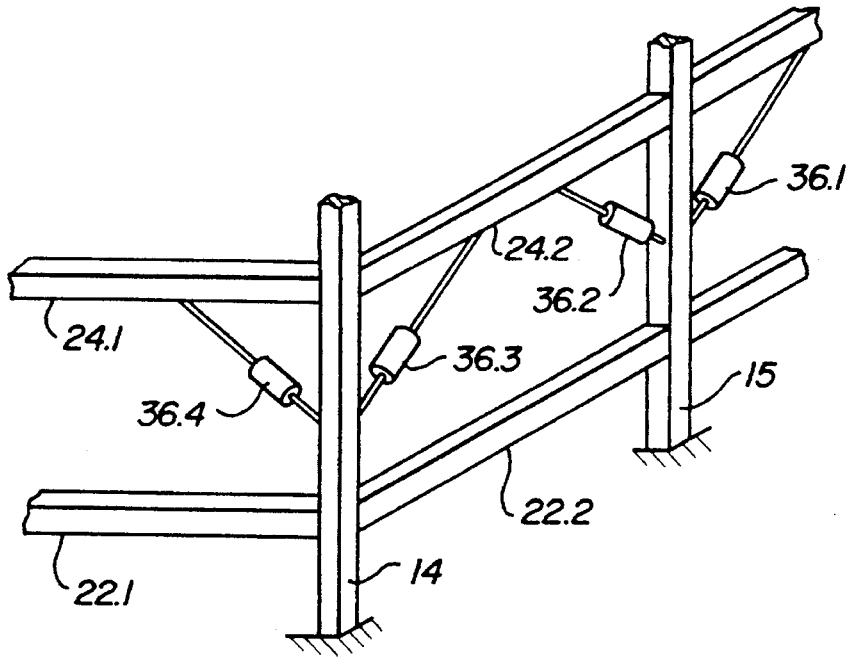
FIG. 3 illustrates a portion of a building structure to which functional switches have been applied in accordance with the principles of this invention.

FIG. 3 is a view similar to FIG. 1 showing a portion of the structure shown in FIG. 1 but with an additional vertical column 15 in the Y-Z plane. This figure additionally shows paired unidirectional functional switches indicated generally at 36. (While unidirectional switches are illustrated in FIG. 3, it should be obvious that the preferred bidirectional switches could be employed, the directional switches being discussed below in connection with FIGS. 17, 18, and 26–28.) Thus, as illustrated, there are a pair of unidirectional functional switches 36.1 and 36.2 lying in the Y-Z plane and extending between the column 15 and the horizontal beam 24.2. At the corner of the structure are two additional functional switches 36.3 and 36.4, the functional switch 36.3 lying in the Y-Z plane and extending between the corner column 14 and the horizontal beam 24.2 and the other functional switch 36.4 lying in the X-Z plane and extending between the vertical column 14 and the horizontal beam 24. It is possible for the switches 36.3 and 36.4 to either transfer of dissipate energy from one plane to the other.

Figure 4A:
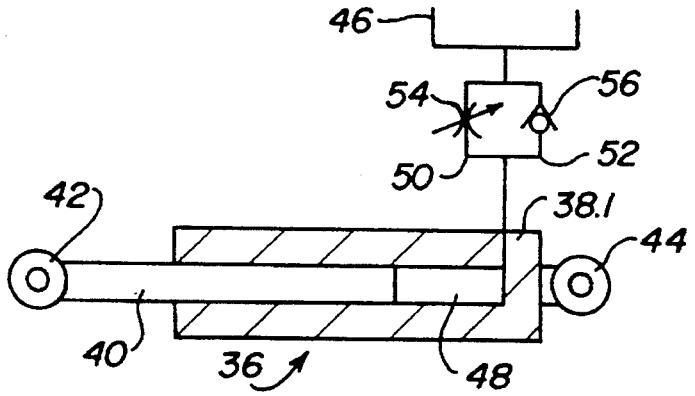
FIG. 4A is a schematic diagram of a unidirectional functional switch.

A unidirectional reusable functional switch, indicated generally at 36, is illustrated in FIG. 4A, this functional switch including a cylinder 38 and a rod 40 which is received within the cylinder 38. One end of the rod 40 is provided with a suitable eye 42 or the like which can be secured to a suitable fixture (not shown) carried by the beam 24. The end of the cylinder 38 remote from the rod end 42 is provided with a bracket 44 which can be suitably secured to the column 14 or 15 by a link (not shown). In addition to the piston and rod assembly, the unidirectional functional switch 36 may also include a reservoir 46. The reservoir is connected with the fluid chamber 48 within the cylinder 38 through a suitable port 38.1. A fluid circuit extends between port 38.1 and the reservoir 46, the circuit being provided with parallel branch lines 50, 52. A regulator in the form of a variable orifice or restrictor 54 is provided in one of the branch lines 50, and a one-way check valve 56 is provided in the other branch line 52. When the structure 10 is deflected in a manner which may cause the functional switch 36 to be compressed, the check valve 56 will prevent flow through line 52 and the variable orifice may be set to a "damp" condition so that the energy of deflection will be absorbed by the switch. However, if the functional switch were to be extended, fluid may move freely from the reservoir 46 through line 52 and check valve 56, and also through port 38.1, the switch then being in an "off" condition. The variable orifice or restrictor may employ a mechanical controller, as for example by a bell crank which senses movement between the rod 40 and cylinder 38, the bell crank in turn being coupled to a suitable valve. Alternatively, the variable orifice may be controlled by an electromechanical device which is coupled to a suitable electronic device. Two unidirectional functional switches may be assembled together so that in both directions one can have "on" "off" and damp functions. A bidirectional functional switch will be discussed later.

Figure 4B:
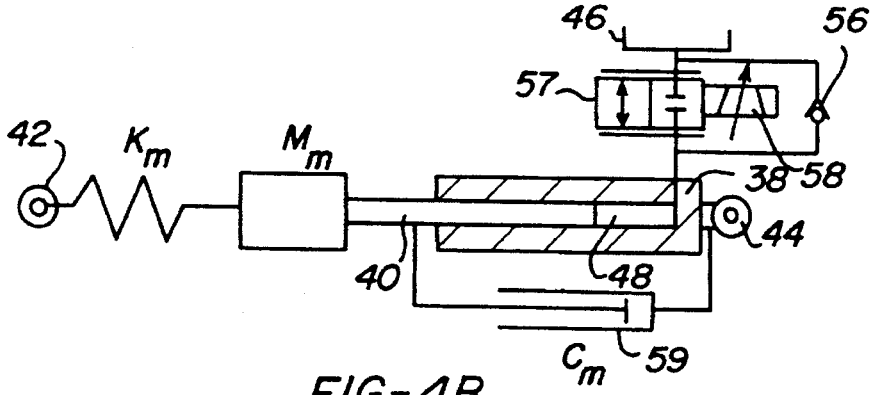
FIG. 4B illustrates the dynamic model of the functional switch shown in FIG. 4A.

In FIG. 4B the dynamic model of the unidirectional functional switch is illustrated. (This model is also valid for a bi-directional assembly.) The connectors and other parts of the assembly always have stiffness and masses, the modified stiffness and masses being denoted $K_m$ and $M_m$, respectively. In this figure, the function of the variable orifice 54 is achieved by a variable valve 57 which may be progressively moved from a fully closed position to a fully open position by a suitable control such as a linear electrical device 58. The damping C [equation (1)] is provided by the variable orifice of the valve as it is moved between its extreme positions. However, if the damping must be very high, and the orifice in the variable orifice valve 57 cannot supply such a high range of damping, an additional damping mechanism 59 may be used. However, the stiffness $K_m$ and mass $M_m$ can be mainly contributed by the switch system itself. The value of C, $K_m$, and $M_m$ are determined in the following criteria: The damping C must be high enough to dissipate the energy stored in the switch system during the half cycle when the switch is "off". However, overvalued C will decrease the response speed of the control valve. The value $K_m$ is determined in a manner set forth below in connection with equation (9). The value of $M_m$ is determined to achieve optimal energy dissipation including optimal work done by the mass against the external force. However it is constrained by the response speed of the switch system. Overvalued $M_m$ will also decrease the response speed as does the damping C.

Figure 5:
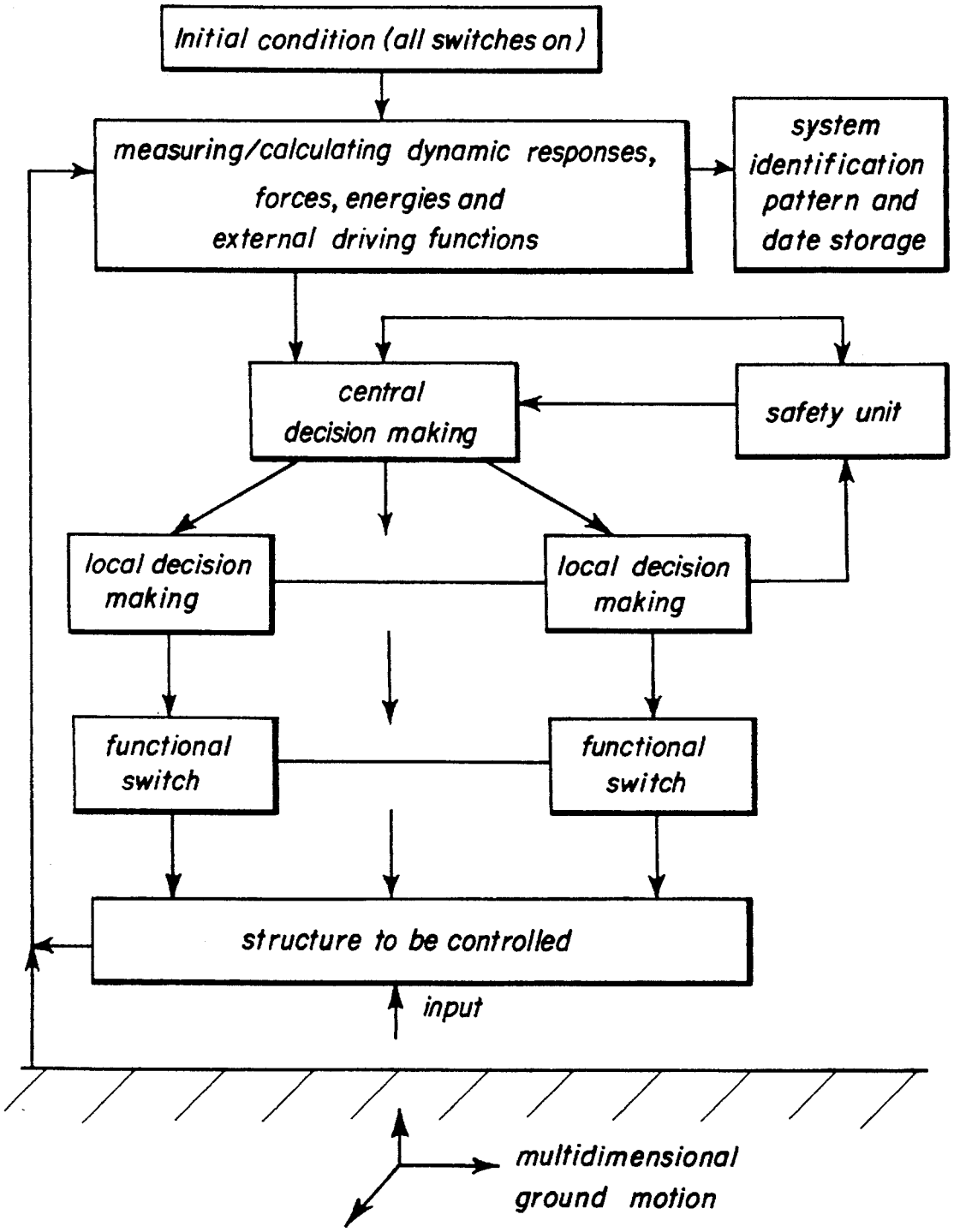
FIG. 5 is a graphical flow chart for the control program developed in accordance with this invention.

FIG. 5 illustrates a graphical flow chart for a multi-degree of freedom seismic vibration control. According to this scheme, initially all of the switches are set to be "on". The dynamic responses, the internal and external forces, the modal energy status and/or ground motions are measured and calculated when the structure is subjected to multi-dimensional ground motion. The measured and calculated data are stored all the time. A system identification unit may be used to obtain certain modal parameters that are also stored in the storage unit. When the response level exceeds the preset values, the central decision-making unit will give orders to initiate local decision-making units. The preset values are decided as follows:

1) If the RSM system is used together with other conventional controls, the preset values can be higher to allow these controls to perform first; 2) If the RSM system is used alone, the values should be lower, even zero. In this case, the preset values are to lower the required precision of the RSM system to lower the manufacturing cost.

Another important function of the central decision-making unit is to identify the optimal set of specific functional switches and their on/off status with respect to global results. Thus, a local substructure may achieve a minimal response, but this minimal response may lead to very large deformation of another substructure. On the other hand, a local point may show a large deformation and absorb significant amount of vibrational energy and reduce the global vibrational level. After the central unit initiates the orders, the local decision-making units start to calculate the optimal results and give the on/off order to each functional switch individually. According to the orders, each switch is set to be "on" "off" or "damp" to reduce the vibration level. At the next time interval, the vibratory signals are measured again and a new cycle of control is initiated. When the external excitation and the structural vibrational levels are reduced to certain values, the central unit gives orders to stop the entire control process.

Figure 6:
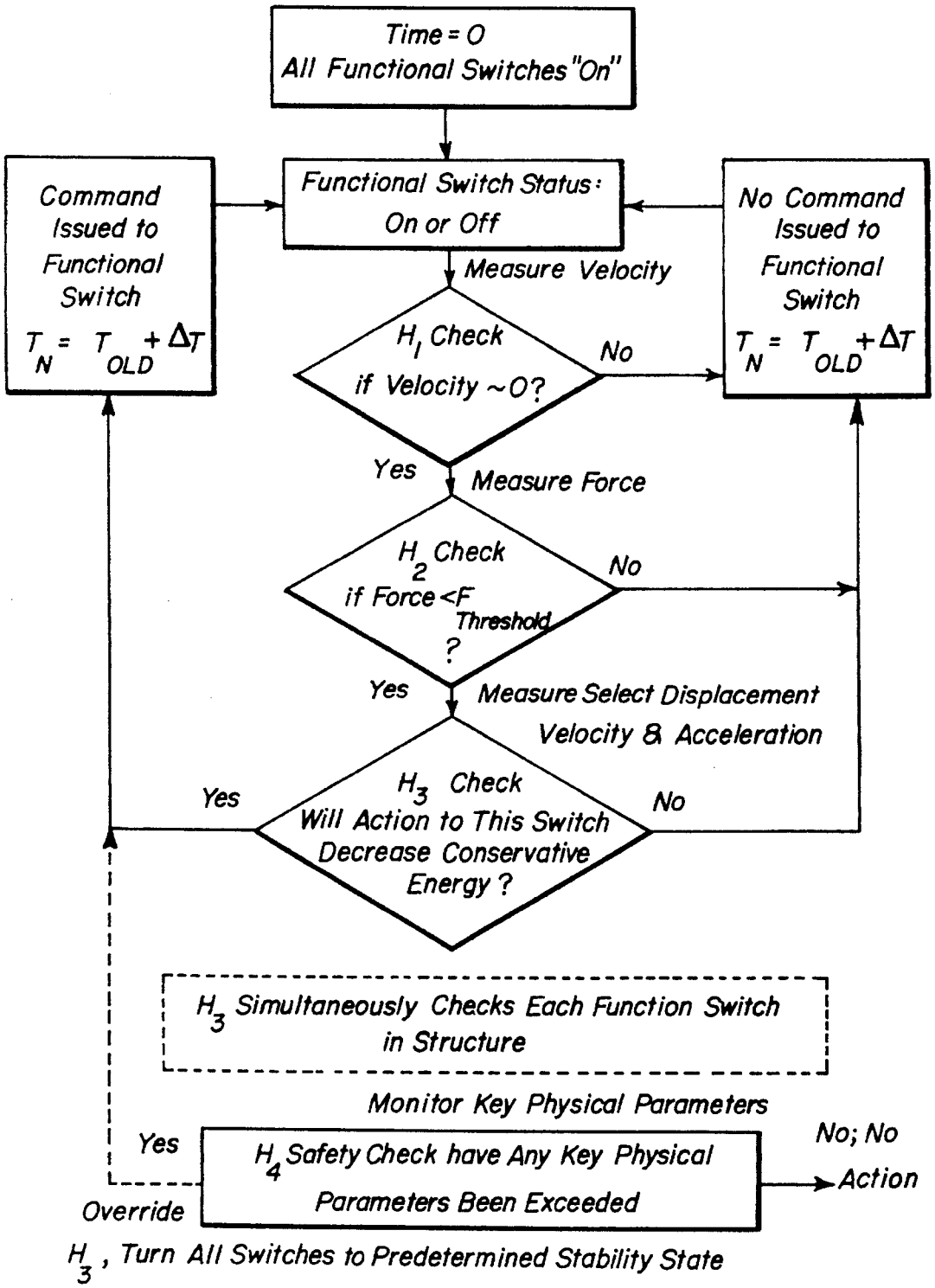
FIG. 6 is a decision making flowchart of the RSM control process showing the hierarchical control loops.

The control system described above is implemented by a computer program which will perform a sequence of steps arranged in a hierarchical manner. The program performs local structural controls, global structural controls and safety checks to insure structural integrity in the event of a malfunction. FIG. 6 is a flowchart representation of the sequential control program for RSM.

For the purpose of the flowchart of FIG. 6, it is assumed that a multi-storied structure is equipped with a number of functional switches and that the RSM system is not used with other controls. In this flowchart these switches are deemed to have only two physical states: "on" (stiff member) or "off" (zero stiffness member). The control scheme begins with all functional switches set initially to the "on" position.

The lowest level of control provided by the sequential control program is called the initial local structural control level or $H_1$ control loop. Each functional switch in the structure is equipped with the necessary control devices to perform $H_1$ control, and accordingly, each set of $H_1$ control devices controls only the local functional switch it is associated with.

The general control loop utilized in the $H_1$ control loop consists of a functional switch, a velocity transducer and control electronics. The velocity transducer may be mounted in a variety of manners with the purpose of measuring the relative velocities between two adjacent floors in a multiple story structure. The functional switch associated with this velocity transducer is mounted between the same two adjacent floors as the velocity transducer.

Figure 7B:
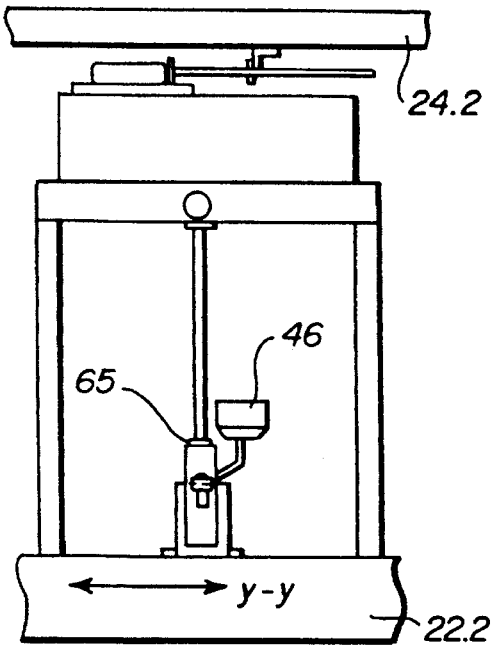
FIGS. 7A and 7B illustrate a typical arrangement of the control hardware at the initial local structural control level in this invention, FIG. 7A being a front view and FIG. 7B being a side view.
Figure 7A:
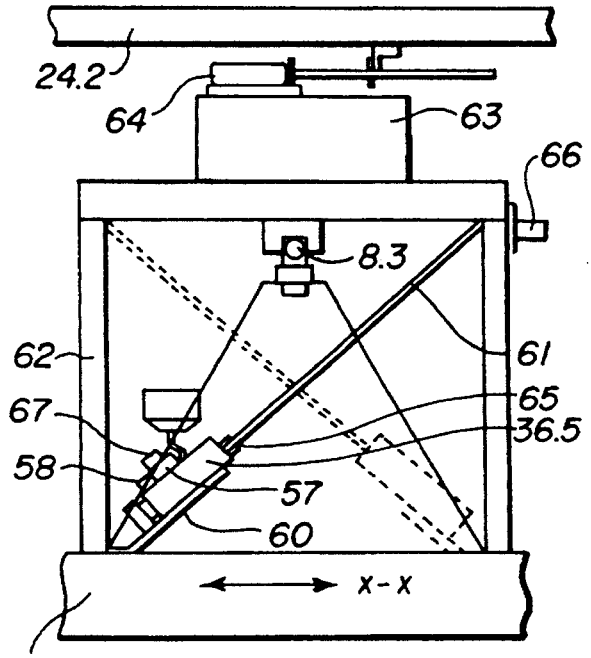

FIGS. 7A and 7B show a basic arrangement of a single functional switch 36.5 mounted in a structure such as that set forth in FIG. 3. The switch 36.5 may be of the type shown in FIG. 4A. In this figure the switch is connected to a lower horizontal beam 22.2 via a support 60 and to an upper horizontal beam 24.2 via a brace 61 and intermediate frame 62 which supports a mass 63. A velocity transducer 64 extends between the mass 63 and the upper beam 24.2. A force transducer 65 is mounted between the brace 61 and the functional switch 36.5. Finally, an accelerometer 66 is mounted on the frame 62. The velocity transducer measures the relative velocity of the upper floor 24.2 with respect to the lower floor 22.2, and initiates a signal to the $H_1$ control means or processor 67 which in turn sends a signal to the linear electrical device 58, which in this embodiment is a two position solenoid, to either turn the switch "on" or "off" by operation of valve 57.

Figure 8:
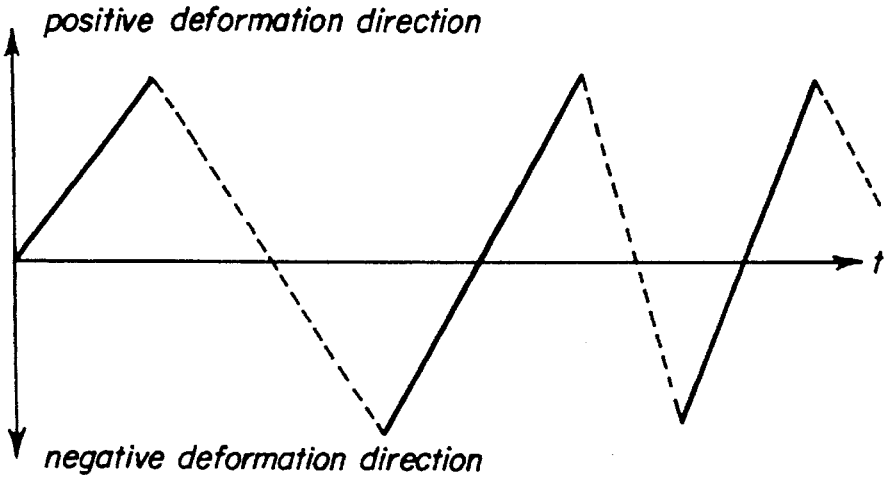
FIG. 8 illustrates the switching of a functional switch while undergoing initial local structural control.

The $H_1$ loop operates in the following fashion. The $H_1$ processor first analyzes the velocity transducer output and, as the relative velocity approaches zero, the $H_1$ processor issues a command to the control valve of the functional switch which has the effect of reversing the current status of the device 58, either turning the switch "on" or "off" as required. The performance of the $H_1$ loop action is shown in FIG. 8. The net result is that the functional switch is alternated between "on" and "off" status at the time when the local velocity of the structure approaches zero.

The control electronics embodied in the $H_1$ processor which are necessary to execute $H_1$ control are located near or on the associated functional switch. The electronics consist of a power amplifier to amplify the output of the velocity transducer 64, decision making electronics, and a power amplifier to send a suitable control command to the solenoid 58 of control valve 57 of the functional switch 36.5.

Figure 9A:
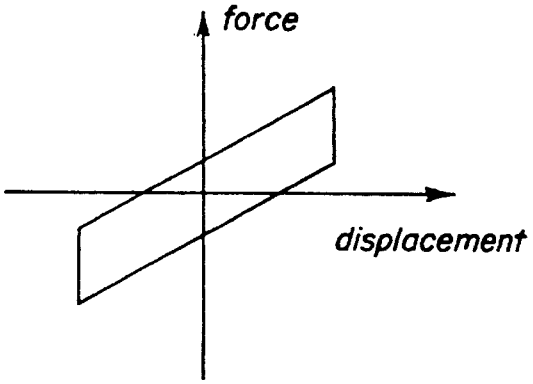
FIG. 9A illustrates the Force vs Displacement plot for a functional switch operating under initial local structural control.

The $H_1$ control method has been described above as a method for switching stiffness elements "on" and "off" but it may readily be used to switch mass or damping elements. In a very simple form of structural control, the $H_1$ loop will provide significantly improved energy dissipation characteristics over conventional methods, and it can operate as an independent control system. FIG. 9A displays the results of the $H_1$ loop as a stand-alone control device on a simple structure. The loop of energy dissipated is ideally a parallelogram. The two sides perpendicular to the x axis stand for the force drop without change of displacement. The other two sides stand for the stiffness of the entire system. It can be proven that, given a certain amount of stiffness, the parallelogram offers the maximum energy dissipation from RSM. In a SDOF system, this energy loop satisfies the Minimum Conservative Potential Energy described in equation (5).

However, to achieve better system performance, hierarchical controls may be implemented to check other system criteria, which other criteria may override the local control of the $H_1$ loop. A second level of control is known as the $H_2$ loop. This is similar to the $H_1$ loop in that it is also a form of local control. FIGS. 7A and 7B also represents the components associated with the use of this loop. A measurement of force is taken from the force transducer 65. The force measurement is taken at the same time as the $H_1$ loop performs its velocity check. If the $H_1$ loop determines that the relative velocity is near zero, the $H_2$ loop will then be activated, and the force measured is compared to a small threshold force stored in the memory of the $H_1$ processor 67.

If the force measured exceeds the threshold force, no action is taken by the controller. After a selected time interval, determined by a timer within the processor 67, the $H_1$ and $H_2$ control loops are again called into operation.

Figure 9B:
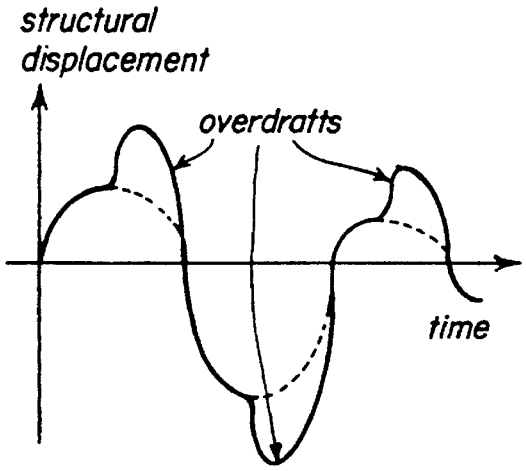
FIG. 9B illustrates the structural overdraft deflection which may occur if initial local structural control is used in the absence of any higher level controls.

The purpose of the $H_2$ loop is to avoid the development of unbalanced forces in a structure. As explained in the discussion of the $H_1$ loop, switching occurs at the point where relative velocity approaches zero. For a typical structure, the dynamics of a building under vibration approximate sinusoidal motion. Thus at the instant velocity is zero, displacement will be at a maximum. Since the ground motions of an earthquake are random, there exists the possibility that a functional switch may be commanded to have zero stiffness at the same instant an undesirable external force propagates through the structure. The net effect will be to cause an overdraft in the deformation of the structure if the functional switch is controlled solely by the $H_1$ loop. This phenomena is shown in FIG. 9B. The $H_1$ loop will thus override the command of the $H_1$ loop in this situation, causing the system to pause until the force situation becomes more favorable.

The $H_2$ loop is intended to act at a local level. Thus each functional switch will have the H2 control loop integrated into its own control electronics, along with the prior discussed $H_1$ control loop.

The next level of hierarchical control in the sequential control program is in the $H_3$ loop. This is a global control loop which is responsible for overseeing the control of each functional switch in the structure. After the $H_2$ loop of each functional switch has performed its comparison, the command to the functional switch must be verified by the $H_3$ loop before allowing the command to be executed.

The $H_3$ control loop operates by measuring structural displacement, velocity and acceleration at a number of strategic locations throughout the structure. These measurements are then utilized by the $H_3$ loop in order to calculate the conservative energy of the structure. The goal of this loop is to minimize the conservative energy. The $H_3$ loop then analyzes the command from the $H_2$ loop in order to determine whether or not the $H_2$ control signal to a given functional switch will tend to decrease the conservative energy of the structure. If the control signal will decrease the conservative energy, then it is sent to the functional switch. If the signal will tend to increase the conservative energy, then the command will not be allowed to issue to the functional switch.

The $H_3$ loop is a global loop in that it simultaneously checks the status of all functional switches in real time and issues optimal commands according to the principle of minimization of conservative energy. It acts as a central decision making unit. Thus, only one set of control electronics is utilized to implement the $H_3$ loop. The decision making process of the $H_3$ loop will be repeated at subsequent time intervals until external excitation and structural vibrations are reduced below pre-established levels.

Figure 10:
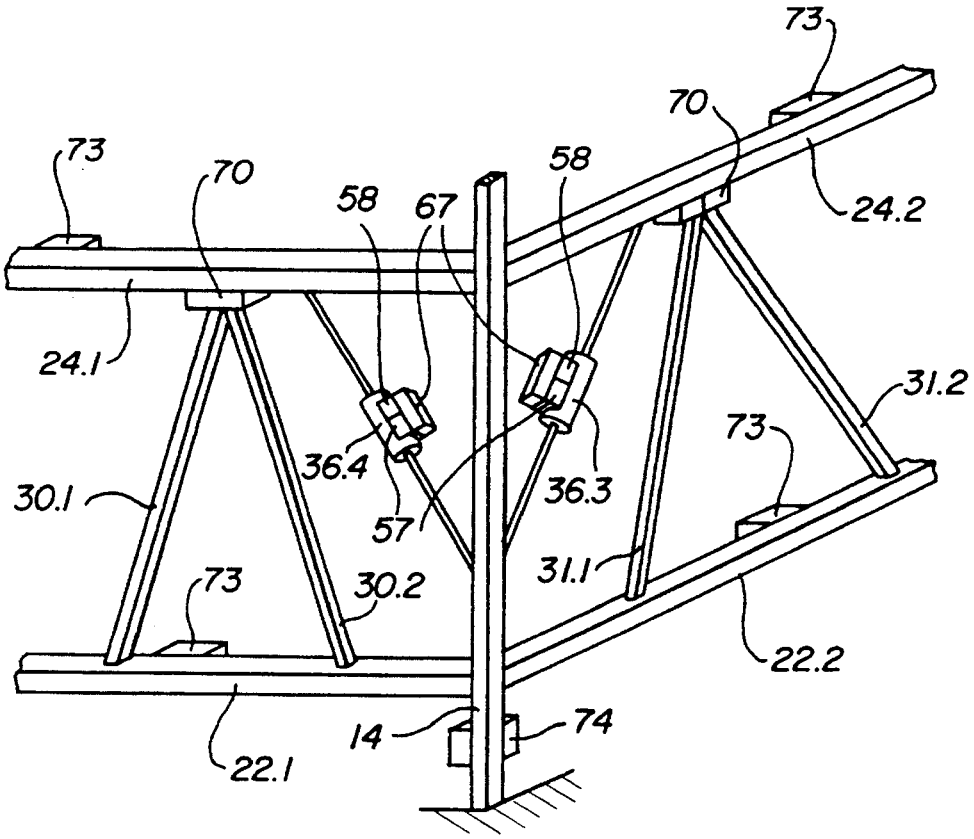
FIG. 10 illustrates a structure provided with global loop control which simultaneously checks the status of all functional switches in real-time and issues optimal commands according to a selected principle.

The application of the $H_3$ loop can best be appreciated from FIG. 10. This figure is similar to FIG. 3, but additionally shows the various control devices which are necessary for the performance of the $H_3$ control. In order to measure velocity, chevron bracing beams 30.1, 30.2, 31.1 and 31.2 are provided, these being secured at their lower ends to horizontal beams 22.1 and 22.2. The upper ends of the bracing beams are secured to each other and are interconnected with upper horizontal beams 24.1 and 24.2 via velocity transducers 70. Also mounted on the structure are sensors 73 which are capable of measuring displacement and/or acceleration. The output signals from sensors 70 and 73 are received by a computer 74 which processes the received signals and sends out suitable signals to the $H_1$ processor 67. The computer 74 also receives feedback signals from the $H_1$ processors.

The $H_3$ loop may be implemented through a number of conventional controls, such as proportional-integral-derivative (PID) feedback, state space feedback or various optimization schemes. A neural network control scheme may also be utilized to perform the large number of calculations required to minimize conservative energy. One possible implementation is through the use of a self learning neural network utilizing a modified associative memory modification method.

As an alternative to the principle of conservative energy, the $H_3$ loop may also utilize a velocity displacement theory as the control criteria for issuing commands to the functional switches. Under this type of control, the $H_3$ loop would only be activated to oversee those discrete portions of a structure where the velocity and/or displacement measurements provided by strategically located transducers exceed certain preset levels.

The final level of control in this scheme is known as the malfunction control loop or $H_4$ loop. The purpose of this loop is to take control of all the functional switches in the structure in the event of a major malfunction in the lower control loop and/or control hardware. A number of measurements of displacement, velocity and acceleration are taken throughout the structure in a continuous fashion. The $H_4$ loop then compares these values to certain maximum preset levels. If the measurements are found to exceed the maximum allowable values, it is indicative of significant malfunctions in the lower level of controls.

In the event that the maximum preset levels are exceeded, the $H_4$ loop will issue a signal to all of the switches in the structure which overrides the signal of the $H_3$ loop and will set all of the functional switches to a state so as to insure the safety and stability of the structure to the extent possible without RSM. This may entail either setting all of the switches in the structure "off" or only setting certain switches "off" based on a prior structural analysis. The $H_4$ loop is considered an independent control loop because it does not continuously monitor the status of each functional switch. Its sole purpose is to provide the appropriate default command signal in the event of system malfunction. The $H_4$ control does not need any additional hardware than that required for the $H_3$ control hardware shown in FIG. 10, but it will be necessary to load the computer with a malfunction program which may override the $H_3$ control output.

Experimental tests were conducted utilizing the functional switch arrangement shown in FIG. 4A on a structure shown in FIGS. 7A and 7B. A shaking table was utilized to simulate ground motion in a two directional manner. The shaking table was operated to simulate two forms of ground motion: sweep sine wave input and random vibration input based on actual recorded earthquake motions. The results of the sweep sine wave input provide information on the equivalent damping ratio of the structure. The earthquake ground motion record is used to measure the effectiveness and capability of this invention.

The results of Tables I–IV represent a comparison of structural response under a number of operating modes. Since these tests represent a single plane application of this invention, only $H_1$ and $H_2$ type control were utilized.

Table I, set forth below, compares the experimental results of four prior art structural damping configurations with the results obtained through the use of a damping type functional switch controlled by the $H_1$ control scheme. The structure was excited with a controlled input acceleration of 0.1 g by the shaker table. The equivalent sinusoidal input displacement to the structure was approximately 4 mm. Configuration 1 represented the structure with one rigid brace with a stiffness equal to that of the functional switch maintained in the "on" position. Configuration 2 represented the structure with one viscous damper as a replacement to the rigid bracing of configuration 1. The damping characteristics were similar to that of the functional switch maintained in the "damp" position. Configuration 3 represented the structure with two viscous dampers mounted in the same plane with damping characteristics each equal to that of the functional switch in the "damp" mode. Configuration 4 is the same as configuration 3 except two conventional viscoelastic dampers were also utilized for vibration control. The "Functional Switch" columns of Table I represents the use of a single damping type functional switch controlled with $H_1$ type control, the first column being experimental data and the second representing theoretical results. The maximum deflection and damping ratio of the structure are listed for comparison and reflect the benefits of the $H_1$ control of this invention in terms of higher damping ratios and lower structural deflections.

Table II represents the results of a test on the same structure as described above, however the input in this test was a controlled constant sinusoidal displacement of 4 mm. The equivalent input acceleration level at the resonant frequency was approximately 0.1 g. The major difference between the results of Table I and Table II is that Table I shows the results of a feedback controlled acceleration test, whereas Table II shows the results of a feedback controlled displacement test.

Table III represents the results of a test on the same structure as described above, however the input in this test was a controlled sinusoidal displacement of 12 mm. The equivalent input acceleration-level at the resonant frequency was approximately 0.3 g. Configuration 1 represents the structure with two rigid braces, each having an individual stiffness equal to that of a functional switch maintained in the "on" position. Configuration 2 represented the structure

TABLE I

| | Config. 1 | Config. 2 | Config. 3 | Config. 4 | Functional Switch Experimental | Functional Switch Theoretical |
|---|---|---|---|---|---|---|
| Damping Ratio - (%) | 8.1 | 13.5 | 18.6 | 23.1 | 33.0 | 34.0 |
| Maximum deformation (mm) | 47.5 | 28.0 | 26.9 | 26.3 | 11.9 | 10.0 |
| RSM reduction (%) | 75.0 | 57.5 | 55.8 | 54.8 | | |

TABLE II

| | Config. 1 | Config. 2 | Config. 3 | Config. 4 | Functional Switch Experimental | Functional Switch Theoretical |
|---|---|---|---|---|---|---|
| Damping Ratio - (%) | 7.9 | 12.9 | 17.2 | 19.4 | 32.7 | 34.0 |
| Maximum deformation (mm) | 32.0 | 15.1 | 12.6 | 12.0 | 8.2 | 7.5 |
| RSM reduction (%) | 74.4 | 45.7 | 34.9 | 31.7 | | |

TABLE III

| | Config. 1 | Config. 2 | Functional Switch Experimental | Functional Switch Theoretical |
|---|---|---|---|---|
| Damping Ratio - (%) | 8.3 | 17.2 | 32.2 | 34.0 |
| Maximum deforation (mm) | 88.2 | 68.1 | 25.4 | 25.0 |
| RSM reduction (%) | 71.2 | 62.7 | | |

TABLE IV

| | | Functional Switch Experimental | Functional Switch Theoretical |
|---|---|---|---|
| Damping Ratio - (%) | 8.1 | 35.2 | 38.0 |
| Maximum deforation (mm) | 27.2 | 6.0 | 6.0 |
| RSM reduction (%) | 77.3 | | |
| Maximum base shear (lbs) | 507.8 | 127.0 | |
| RSM reduction (%) | 77.0 | | |

with two viscous dampers as replacements to the rigid bracing of configuration 1. The damping characteristics of each damper were equal to that of a functional switch maintained in the "damp" mode. Two conventional viscoelastic dampers were also utilized in this configuration. The "Functional Switch" column of Table III represented the use of a single functional switch controlled with $H_1$ type control.

Table IV represents the results of a test on the same structure as described above, except that in this test, two functional switches were employed in a push-pull arrangement instead of a single functional switch. The input in this test was a controlled input acceleration of 0.1 g. The equivalent input constant sinusoidal displacement to the structure was approximately 4 mm. The "Rigid Bracing" column of Table IV represents the structure with two rigid braces, each with a stiffness equal to the stiffness of the functional switches when maintained in the "on" position. The "Functional Switch" column represents the use of two push-pull functional switches controlled by both $H_1$ and $H_2$ type control.

Figure 11:
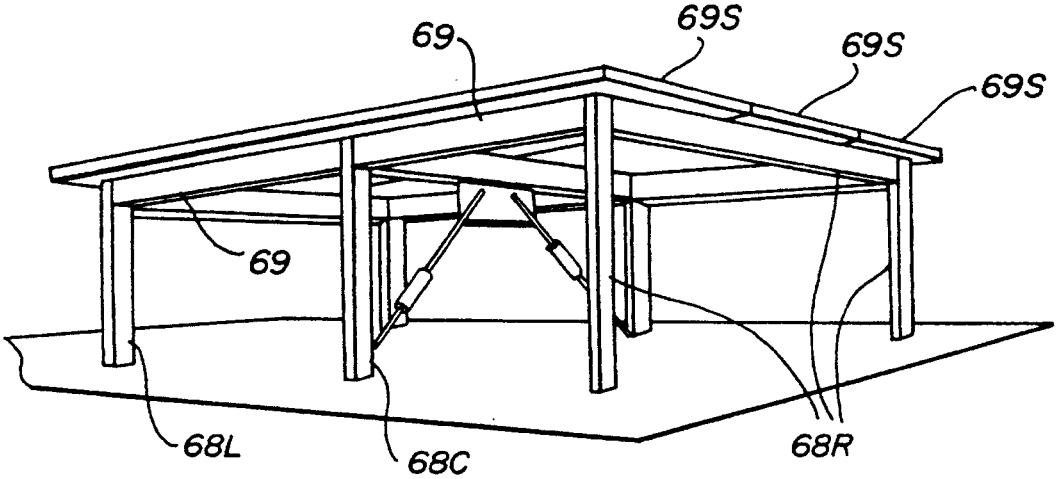
FIG. 11 illustrates a simplified building structure which may be modified in accordance with the principles of this invention.

An application of the present invention can be appreciated from a consideration of FIG. 11. In this figure, a one-story structural system is shown consisting of three inverted U-shaped frames 68R, 68C, and 68L, the three frames being connected at their tops by suitable beams 69. On top of the frames there are three concrete slabs 69S the size of 3 by 12 meters each. The weight of the concrete and other static and live loads are considered uniformly distributed over the top floor. Since the central frame 68C is to be treated with the real-time structural modification system of this invention, a structural analysis is performed for the frame wherein the weight, lateral stiffness, and natural frequency of the structure is determined. From this analysis, it is found that the total load on the middle frame is 35,100 kg. By carrying out a standard analysis, it is also found that the natural frequency of the frame is about 3 Hz and its horizontal stiffness K is 1,170,000 kg/m.

Figure 12:
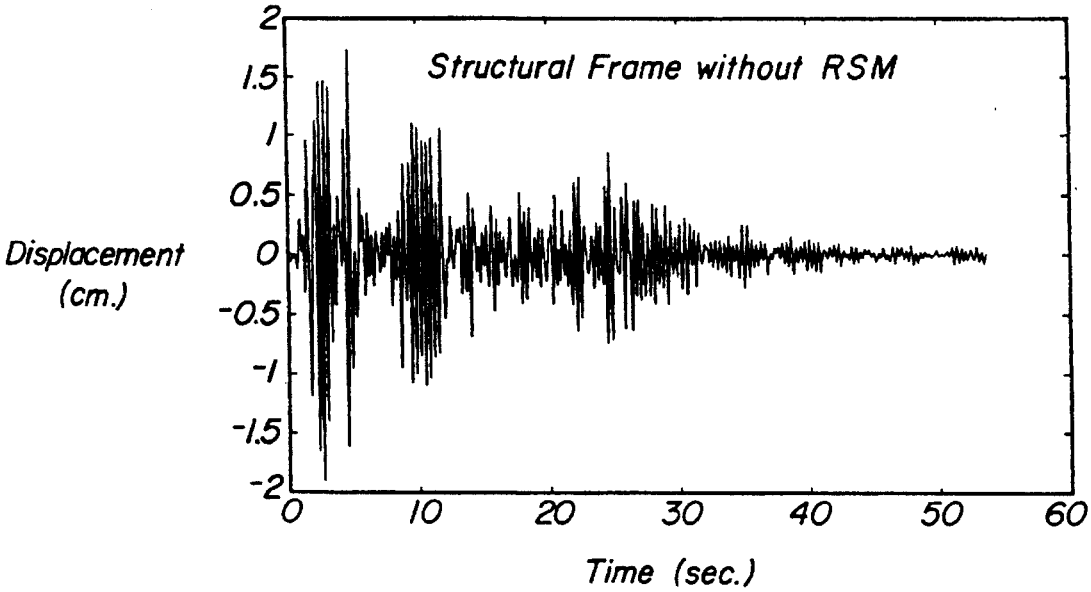
FIG. 12 illustrates calculations on how the building shown in FIG. 11 would resonate when subjected to the earthquake of FIG. 2.

The displacement response of the frame under the recorded 1940 El Centro earthquake (FIG. 2) is calculated and shown in FIG. 12. It is seen that the peak value of the displacement is about 2 cm, which is 1/250 of the frame height of 5 m. According to building code specification, a horizontal displacement of over 1/700 of the story height will result in certain degrees of inelastic deformation of the building structure. Although this is not intolerable, it is desirable that the structure stay within its elastic deformation range. Therefore, the real-time structural modification system of this invention is used to suppress the vibration level back to the code suggest value. Thus a method is selected for minimizing the displacement response of the structure which is based upon the natural frequency of the structure and the percentage deviation from the building code. Normally two steps must be taken when using the RSM system. First a preliminary design is done by using the estimation formula $$X_{max}=\alpha W/(K+2K_m) \quad (9)$$

wherein $X_{max}$ is the maximum displacement allowed, $\alpha W$ is the lateral force, K is the stiffness of the frame, and $K_m$ is the apparent stiffness contributed by RSM by the application of functional switches. From the above formula we learn that to insure the value of 1/700, $K_m$ should be equal to K, namely 1,170,000 kg/m. After the above calculations have been done, structural modification devices are mounted in the structure which are capable of minimizing the displacement of the structure.

Figure 13A:
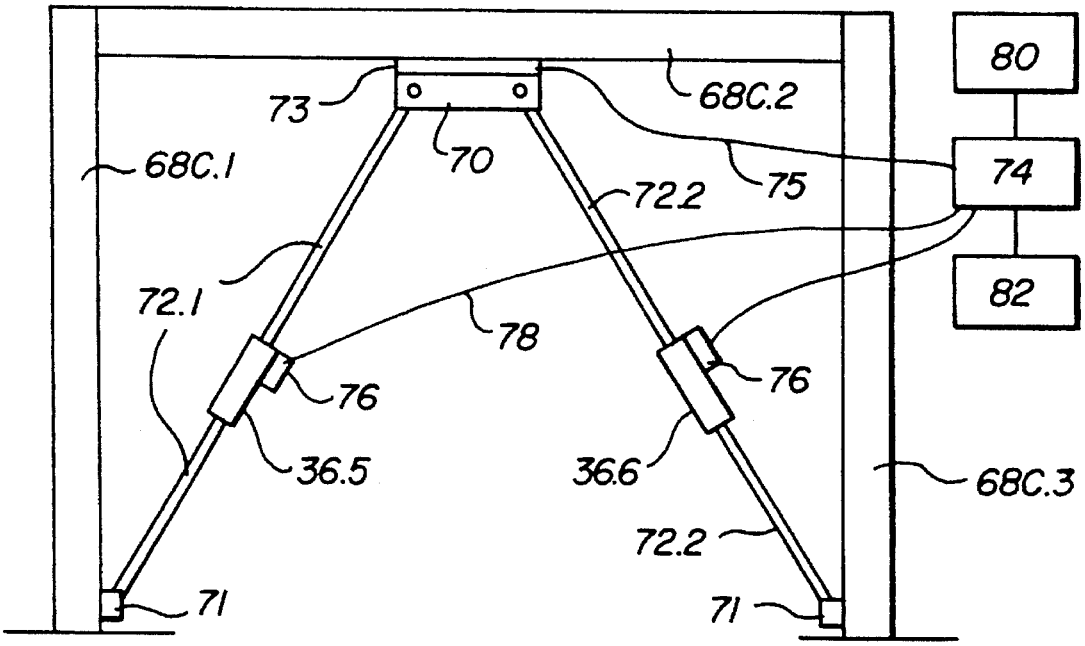
FIG. 13A and 13B illustrate how the building of FIG. 11 may be modified in accordance with the principles of this invention to reduce its structural deflection during the earthquake of FIG. 2.
Figure 13B:
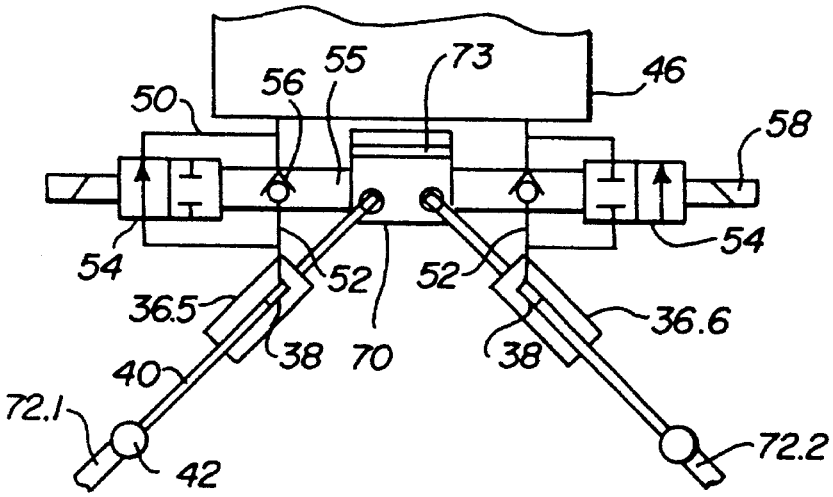
Figure 14A:
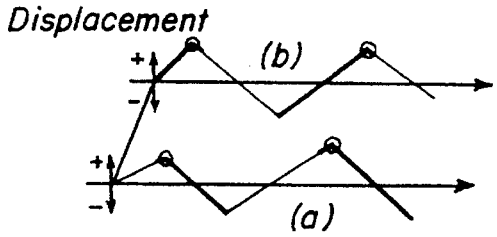
FIG. 14 illustrates how the functional switches shown in FIG. 13 will be turned "off" and "on."
Figure 14B:
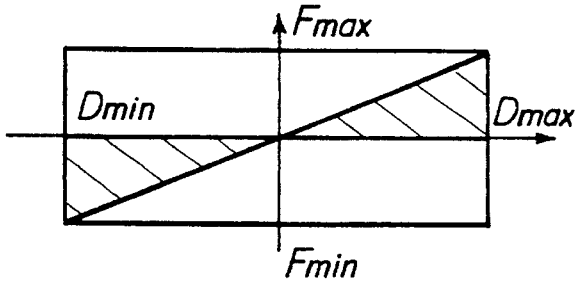
Figure 15A:
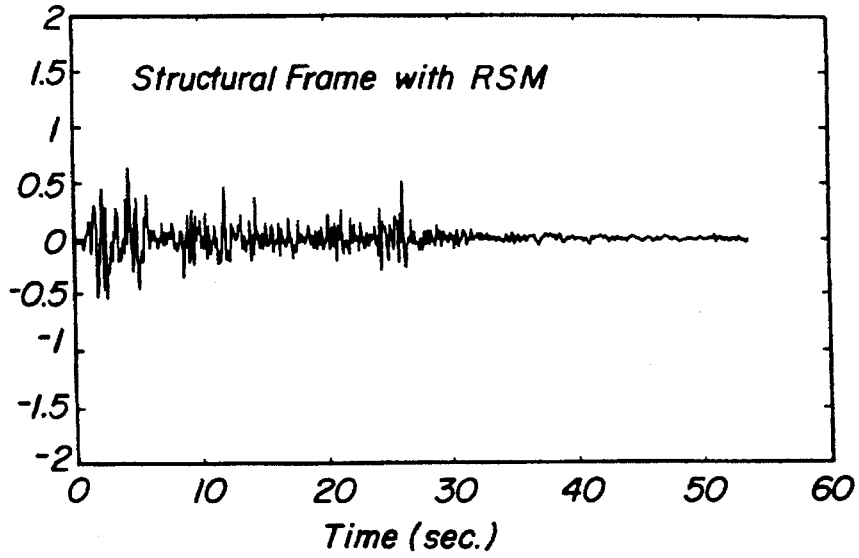
FIGS. 15A and 15B show the calculated response of the structure of FIG. 6, FIG. 15A showing the response when modified in accordance with the RSM system of this invention, and FIG. 15B showing the response when modified by using stiff bracing.
Figure 15B:
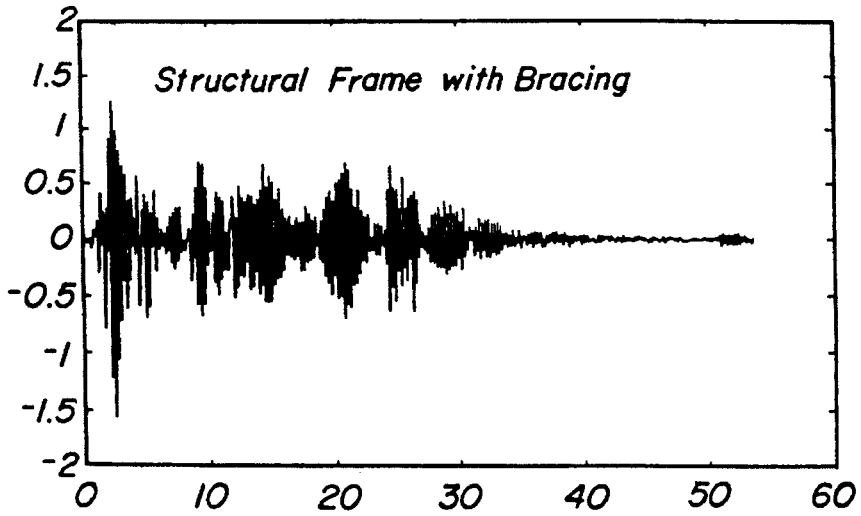
Figure 16:
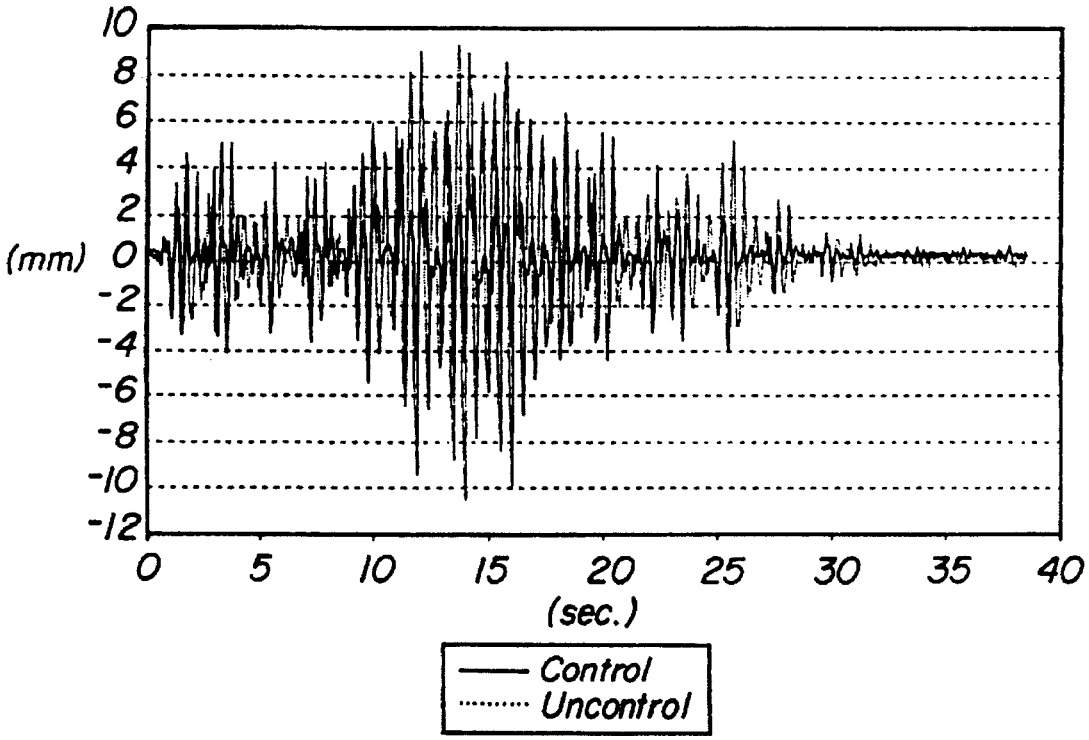
FIG. 16 shows actual test results of a test stand structure when either controlled or not controlled by the subject matter of this invention.

In FIG. 13A an RSM system employing push-pull functional switches is somewhat schematically shown installed on the central U-shaped frame 68C, and a push-pull control of the functional switches is shown in FIG. 13B. First, a special steel beam connector, indicated generally at 70, is welded or bolted on the central horizontal beam 68C.2 of the U-shaped frame, not shown in FIG. 13B. Two steel connectors 71 are securely fastened to the lower end of the vertical column portions 68C.1 and 68C.3 of the U-shaped frame 68. Two bracing members 72.1, 72.2, which incorporate functional switches 36.5, 36.6, are installed between the connectors 71 and the special connector 70 as shown in FIG. 13A. The functional switches 36 make the bracing members become adaptive components of the structure. The added functional switches and bracing members provide an additional stiffness which is 100% of the original stiffness contributed by each set of connector, the switch, and the member. The special connector 70 includes a sensor 73 which may be any suitable transducer capable of measuring the displacement, velocity and/or acceleration of the horizontal beam 68*c*.2 from the base of the columns 68C.1, 68C.3. The sensor 73 is connected to a computer 74 via a suitable electrical cable 75. The computer 74 has available to it stored data and system identification. In addition, as shown in FIG. 13A, each functional switch is provided with a local decision making unit capable of properly operating the associated switch. As the computer receives the information from the sensors, it will process the information and the computer 74 will in turn transmit signals to the local decision making units 76 via lines 78. The system identification and data storage unit is indicated at 80, and the power supply is indicated at 82. Each functional switch may be controlled independently of the other in FIG. 13A. However, in FIG. 13B a control is shown where the switched 36.5 and 36.6 are alternately "on" and "off". Thus the two valves 54 are coupled together by a rigid link 55. When the right hand switch 36.6 is "on" as shown if FIG. 13B, the left hand switch 36.5 will be off. When the right valve is switched to place the right switch in its "off" state, the left will be switched "on". The control command to the functional switches 36.5 and 36.6 mounted as shown in FIG. 13B is approximately shown in FIG. 14. Namely, the functional switches 36.5 and 36.6 are alternatively "on" and "off". Thus, two of the functional switches are used as a push-pull (complementary) pair controlled by adaptive programs to keep the apparent stiffness, damping, and mass unchanged but real stiffness, damping and mass of the structure modified. As a comparison to show the effectiveness of the functional switches as applied to the structure, the same El Centro earthquake record is used to calculate the displacement response of the frame with the functional switches applied. It can be seen from FIG. 15A that the peak value of the displacement response is now 0.7 cm., which is about 1/700 of the frame height. This is a 70% improvement over the results shown in FIG. 12 and it agrees with the preliminary design. Also, to illustrate the difference between using simple bracing and the functional switches, another treatment of the frame with simple bracing of 100% original stiffness is studied. The corresponding displacement is given in FIG. 15B. It is seen that the peak displacement is only reduced to about 1.6 cm. This improvement is less than 20%. While calculated results are shown in FIGS. 12, 15A and 15B, actual results comparable to those shown in FIGS. 12 and 15A are shown in FIG. 16.

In the application just discussed in connection with the structure shown in FIGS. 11 and 13, the functional switches have been used to dissipate energy and to modify the stiffness of the structure in a single plane. However, it should be obvious from FIG. 3 that the functional switches may be used to dissipate energy in more than a single plane. Thus the functional switches 36.3 and 36.4 lie in differing planes. These devices are responsive to variable control (either mechanical or electrical) which is responsive to a measured displacement for controlling the energy displacement device or functional switch in response to the measured displacement to cause the functional switch to dissipate energy and control displacement.

While one design of a functional switch has been shown in FIG. 4A, other designs may be employed. For example, a one-time purely mechanical functional switch may be used in some applications. In its simplest form it may consist of a tube coupled to a rod by a shear-pin. Such a device is suitable for both linear and rotational movement. The device shown in FIG. 4A is unidirectional in the sense that the rod is free to move to the left, the return from the reservoir 46 to the chamber 48 being unrestricted through the one-way valve 56. Thus, the switch is always "off" in one direction, but may be set at "off" "on" or "damp" in the other direction. The shear pin functional switch may also be coupled with a variable rate spring. This design is particularly suitable for small structures mounted on rigid substructures, such as mobil homes mounted on concrete piers.

Figure 17:
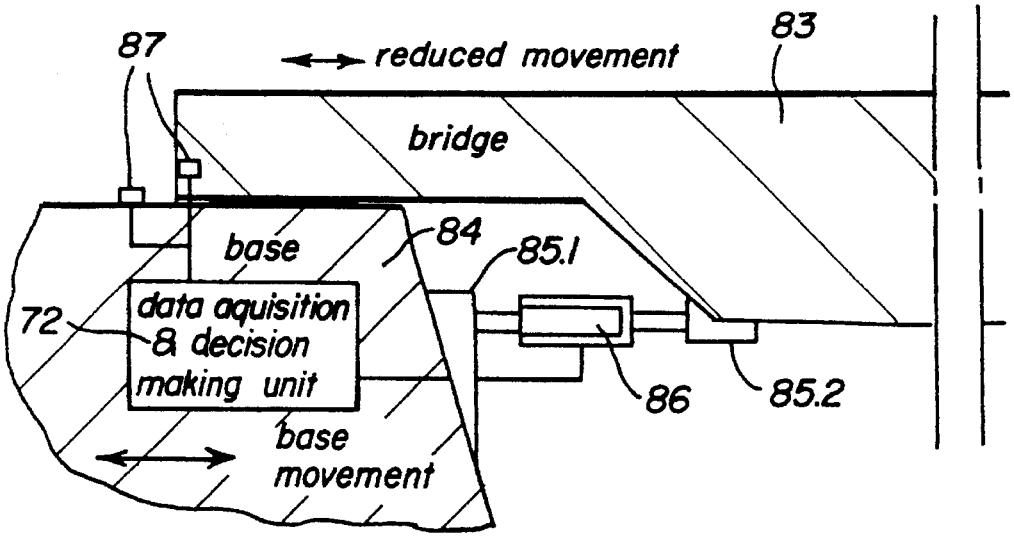
FIG. 17 shows how this invention may be applied to a bridge.

FIG. 17 shows a typical embodiment of the present invention used on a bridge. This embodiment includes a bridge 83 slidably mounted on base 84, and fixtures 85.1 and 85.2 which connect a bidirectional functional switch, indicated generally at 86, to the bridge 83 and base 84. In addition sensors 87 are provided which measure input signals such as displacement, velocity, acceleration, strain, etc. of the system. The sensors are connected to a computer 72 which controls the switch 86 in response to the signals received from the sensors. The switch may be nearly instantaneously switched between "on" "off" and "damp" states by the computer. It should be obvious from an inspection of FIG. 17 that the energy from the ground to the bridge, or vice versa, may be controlled. In addition, it should also be obvious that the structural parameters of the bridge may be varied. For example, the mass of the bridge may be varied by coupling or uncoupling the mass of the base to the bridge. Additionally, the stiffness of the switch may be varied, or the relative movements of the bridge and base may be damped. Thus, the bridge as modified in FIG. 17 is an adaptive structure.

Figure 18:
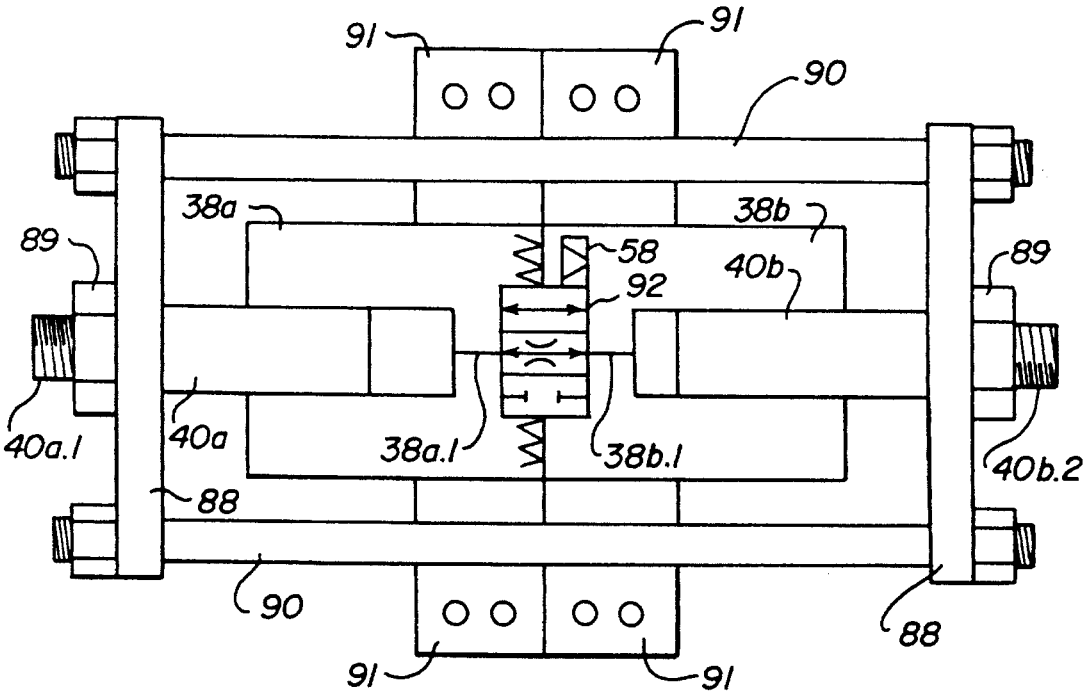
FIG. 18 illustrates a bidirectional functional switch which may be employed in the design shown in FIG. 17.

A design of a bidirectional reusable functional switch is illustrated in FIG. 18, the switch being indicated generally at 86. This design consists of two unidirectional switches of the type generally illustrated in FIG. 4A, with the cylinders 38*a* and 38*b* being mounted end to end with their rods 40*a* and 40*b* extending in opposite directions. The rods are connected together by means of a yoke assembly which includes two transversely extending bars 88 held in place on the threaded ends 40*a*.1 and 40*b*.1 of the rods by means of nuts 89. The bars are in turn coupled together by means of shafts 90, opposite ends of each shaft being suitably connected to an end of an associated bar 88. The yoke assembly may be suitably connected to a fixture 85.2, or any other suitable connector. The cylinders 38 are each provided with brackets 91 which may be coupled to a suitable fixture 85.1 or the like. Each of the cylinders is provided with a port 38*a*.1 or 38*b*.1, the ports being in communication with a reservoir 46 via a three position valve 92. The position of the valve may be determined by an electrical controller 58 which is in turn preferably coupled to a computer 72. While the bidirectional switch 86 may act as a damper when the valve is in its damp position, additional dampers 59 (not shown) may be provided. While the mechanism for controlling the valve may be electrical, a variable orifice valve may be used which can be controlled electrically or through a mechanical device, for example a bell crank which senses movement between the cylinder 38 and the rod 40, or the structures to which the cylinder and rod are connected. If controlled electrically, there is typically only a single "damp" setting in order to improve the response time. While in FIGS. 3, 13, and 17 the functional switches are shown being mounted for tension-compression, the functional switches may also be mounted for bending, torsion, or shear.

Added damping and stiffness (ADAS) has been used in the prior art to modify a building structure to improve its deflection characteristics. However, it is well known that fixed higher stiffness and fixed higher damping does not always help a structure to reduce its vibration level. Varying damping stiffness and damping can achieve much better results. Besides, functional switches can also change the mass of a structure, which can also help to reduce the vibration level. Therefore, by utilizing the functional switches disclosed above, it is possible to modify structural parameters of mass, damping, and stiffness in real-time.

Figure 19:
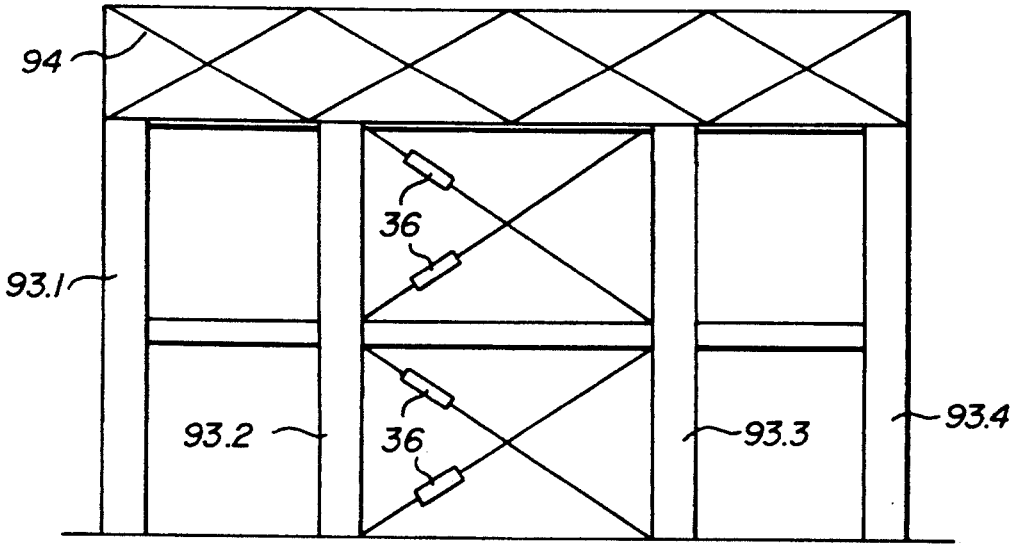
FIGS. 19–21 show how this invention may be applied to other building structures.

With reference now to FIG. 19, a two story structure is shown having vertical columns 93 and a roof truss 94. Functional switches 36 are mounted between intermediate columns 93.2 and 93.3 in the manner indicated. By setting the functional switches "on" or "off" the central columns are either strongly braced or are not braced at all. Therefore the stiffness of the frame can be changed. The functional switches can also be connected to dampers instead of rigid members. Therefore, the physical parameters of mass, damping and stiffness can be changed simultaneously. The functional switches shown in FIG. 19 may be designed to be subject to extension forces only. Therefore, no buckling caused by compression forces will happen. In this way the links and support for the functional switches need much less cross sectional area so that the cost may be lowered.

Figure 20:
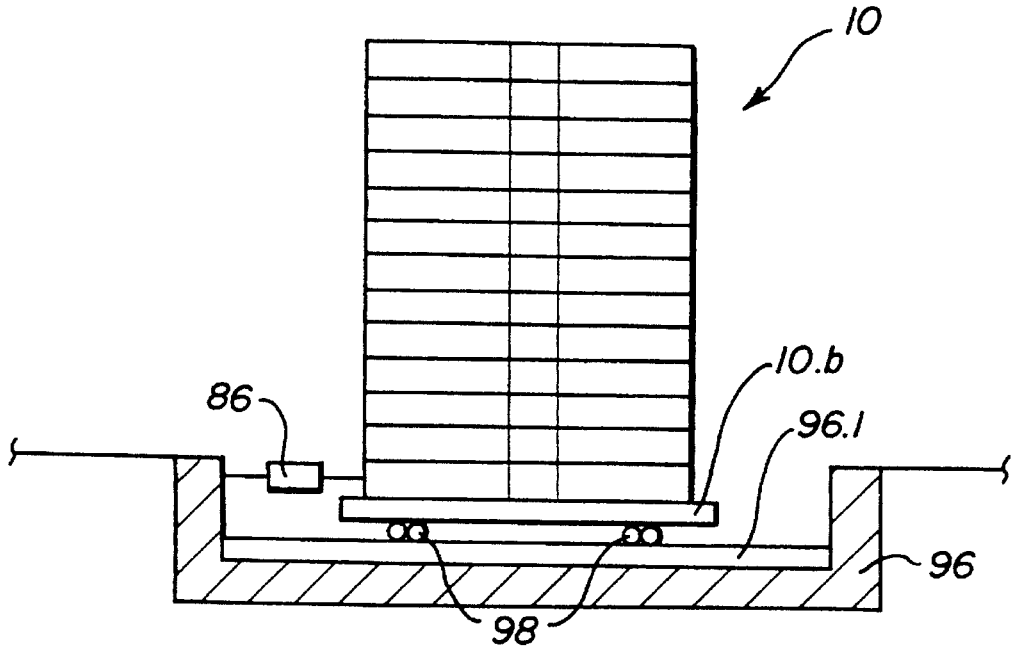

FIG. 20 illustrates a tall building mounted upon a base isolation unit. The tall building is indicated generally at 10, the base at 96, the base including a hard surface 96.1 and the building including rigid base 10*b*. Rollers 98 or the like are disposed between the rigid base 10*b* and the hard surface 96.1 so that the building structure 10 can move relative to the base 96. A functional switch 86 extends between the building 10 and the base 96. This system is different from the design shown in FIG. 19 because it changes the force transfer path and capability from external sources whereas the design shown in FIG. 19 changes the mass, damping, and stiffness of a structure. However, the basic principle is the same as changing the physical parameters of the structure only.

Figure 21:
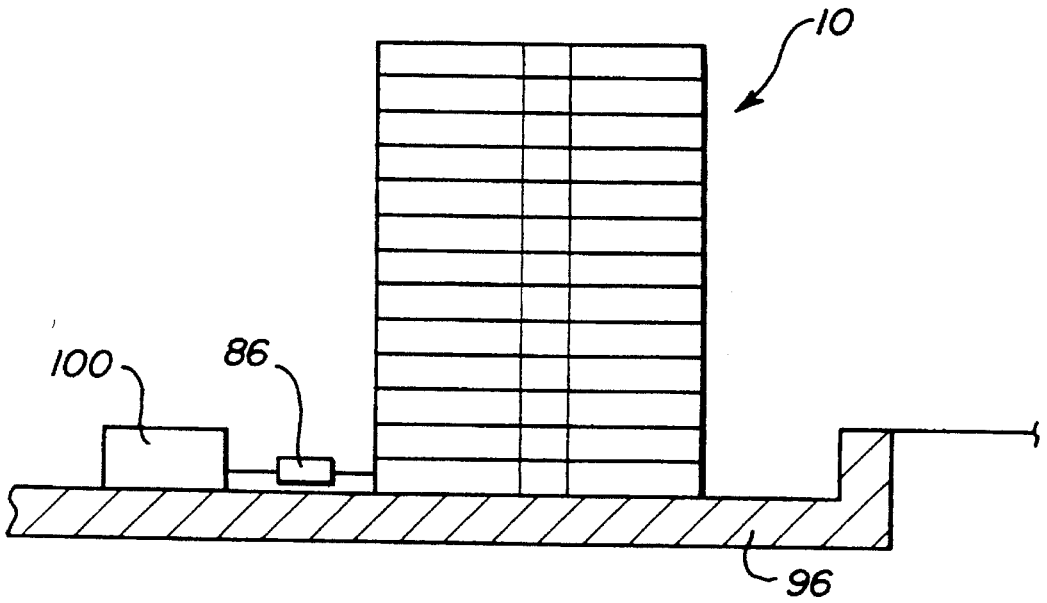

FIG. 21 shows another concept of changing mass. In this design a building structure 10, which is mounted directly upon a base 96, is coupled to a mass 100 by means of a functional switch 86. The mass may be another building. As the building 10 and the mass may have different movements (different frequencies, different phases, and different amplitudes) and may be connected or disconnected by means of functional switch 86, the vibrations of the two objects may cancel each other to a certain degree.

While the control theory of this invention has been referred to in the objects and summary of the invention, it may perhaps be better understood from a consideration of FIG. 22. Shown in FIG. 22 is a building structure which includes shear walls 102, 104, two spaced apart vertical columns 106, and a mass 108 supported by the columns 106. In addition, a first functional switch 110 is positioned between a column 106 and the shear wall 102, and a second functional switch 112 is positioned between the other column 106 and the shear wall 104. The first functional switch 110 is connected to associated shear wall and column by links 114 and 116, and the second functional switch is connected to the associated shear wall 104 and column 106 by links 118 and 120. Each of the shear walls has a stiffness, the stiffness of shear-wall 102 being expressed as $K_1$, and the stiffness of shear wall 104 being expressed as $K_2$. According to the principle of minimal conservative potential energy a simple and very effective algorithm is established by switching the stiffness between $K_1$ and $K_2$ to achieve maximum energy drop and minimum displacement. Assuming $K_1=K_2$ switching between the two shear walls 102 and 104 maintains the apparent stiffness constant as $K+K_1$ or $K+K_2$ keeps constant. However, the two additional stiffness $K_1$ and $K_2$, stores and drops potential energy alternately. When the mass 108 is caused to move in the direction of arrow 122 the functional switch 110 is switched "on" while the functional switch 112 is switched "off". If the maximum displacement of the mass caused by the ground motion in the direction of the arrow 122 is $x_1$, the energy stored in the additional stiffness is $K_1x_1^2/2$. When the mass starts to move in the direction of the arrow 124 the switch 110 is switched to its "off" position, and the switch 112 is switched "on". At this time the stiffness $K_1$ can move freely and release the energy stored. Thus, the stored energy $K_1x_1^2/2$ is released. An energy dissipation mechanism, associated with the functional switch 110 dissipates this amount of energy within the duration of the movement of the mass in the direction of the arrow 124. Meanwhile, since the functional switch 112 is "on", the stiffness $K_2$ of shear wall 104 starts to work together with the stiffness K of the main frame 106. That is to say that the stiffness of shear wall 104 ($K_2$) starts to restore the potential energy until the mass reaches the maximum displacement in the direction of the arrow 124, the maximum displacement being denoted by $x_2$. Similarly, this amount of energy is equal to $K_2x_2^2/2$ which is to be dropped in the next movement of the mass 108 in the direction of the arrow 122. The time history of this algorithm is conceptually shown in FIG. 23. In this figure the solid line 126 shows the deformation when the functional switch 110 is "on" and the functional switch 112 is "off". The dotted line 128 shows the deformation when the functional switch 110 is "off" and the functional switch 112 is "on".

While the equation previously set forth at (5) is applicable to a single degree of freedom system, in a multi-degree of freedom structure the situation becomes a little more complicated. Thus equation (5) becomes $$E^i_{kc}+E^i_{kf}+E^i_d+E^i_{df}+E^i_{pc}+E^i_{pf}=W^i=T^i \tag{10}$$

Here, comparing with equation (5), the newly introduced superscript i describes the $i^{th}$ mode and the letter T stands for the energy transferred from modes other than the $i^{th}$ mode. The term $T^i$ can be either positive or negative. However, referring to the first mode, or even the first several modes, the term $T^i$ is positive in most cases [Liang and Lee, "Damping of structures: part I theory of complex damping", NCEER report 91-0004, 1991]. Therefore, the task to minimize the modal conservative potential energy includes minimizing the modal energy transferal also.

This principle is that M, C, and K must be changed in such a way that the minimal conservative energy must be achieved. In other words, during the external excitation, the total external energy is treated as follows: prevent a portion of the energy from entering the structure; allow the remaining in, then damp some, and keep some which will be used later to do certain work to prevent external energy from getting in the next step. In a MDOF system, an arrangement that only satisfies equation (5) may not be enough, another amount of energy, the modal energy transfer, should be taken into consideration.

In FIG. 24, the theoretical response of a switch is shown. At point 1, the switch starts to be compressed, since the orifice is set to be "on" no fluid can pass the orifice. At point 2, the force reaches its maximum value without any displacement allowed. However, when the force begins to change its direction, the orifice is suddenly released, the "off" condition is achieved and the switch is allowed to move, in a very short period, the force is dropped to its minimum value at point 3 and the maximum displacement between the switch is achieved, which equals to the maximum allowed displacement of the structure at the specific points where the functional switch is mounted. Shortly after the point 3, the switch is still in free movement of "off" condition but the displacement begins to decrease until the next compression begins at point 1. Note that, if the excitation is random, instead of sinusoidal, the response will not look like the experimental response shown in FIG. 25. It can be seen that the theoretical estimate of FIG. 24 agrees the experimental data shown in FIG. 25 very well.

Figure 27:
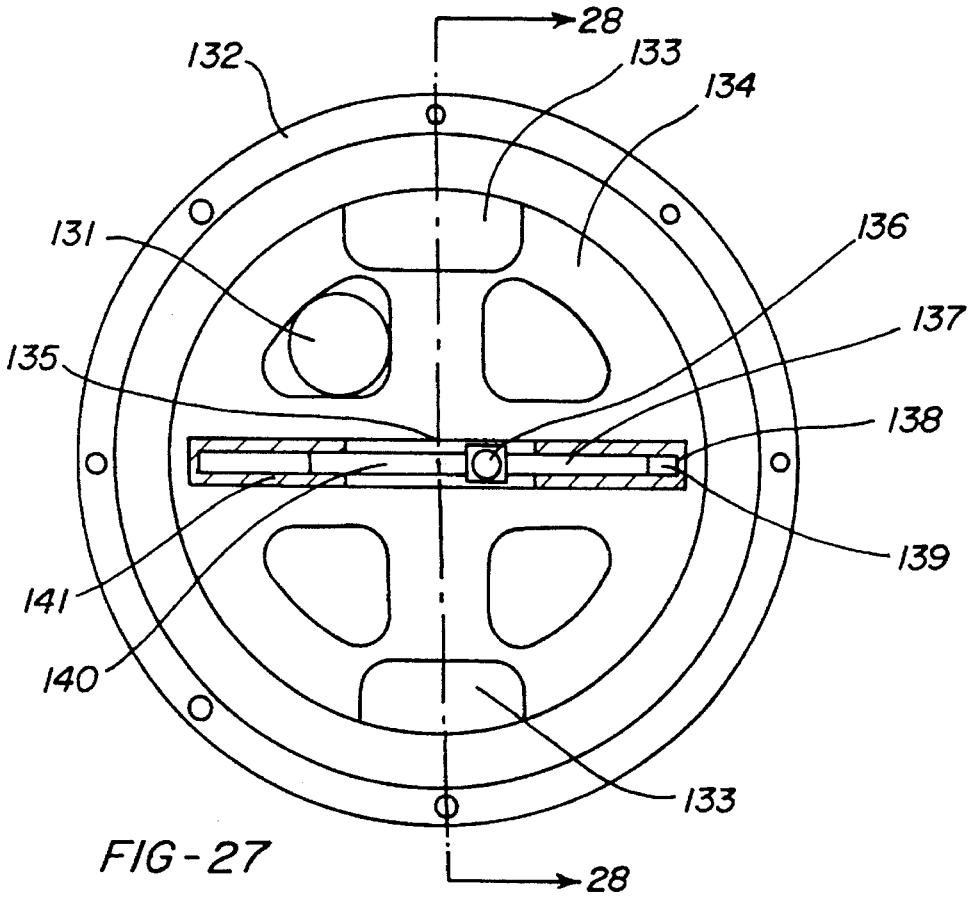
FIG. 27 is a view taken generally along the line 27—27 in FIG. 26.
Figure 26:
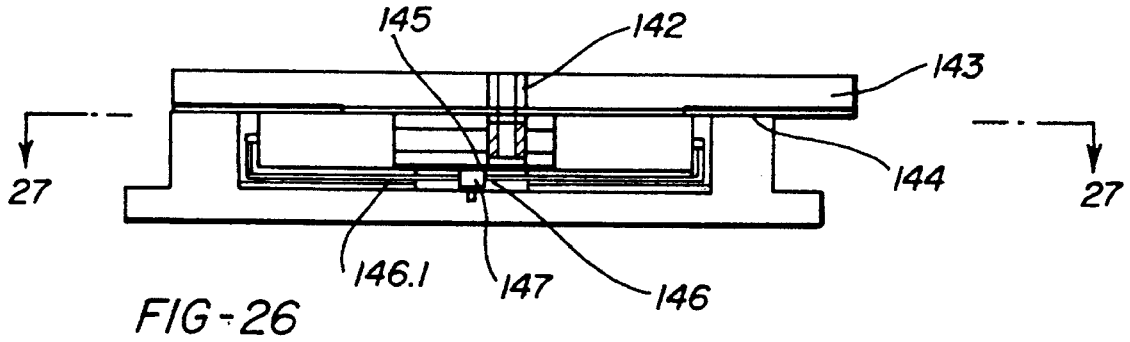
FIG. 26 is a side view of a four-way functional switch.
Figure 28:
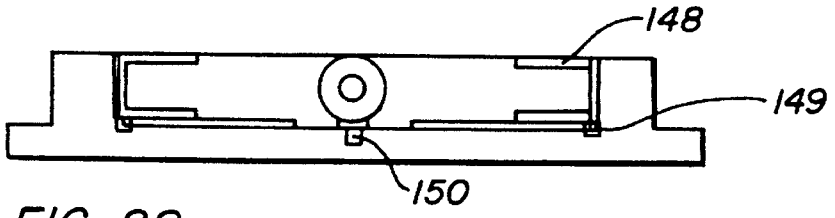
FIG. 28 is a sectional view taken generally along the line 28—28 in FIG. 27.

A four-way switch system is shown in FIGS. 26–28, which system can be operated in two modes to allow the switches act in both X and Y directions. In FIG. 27, 131 is an oil reservoir; 132 is a mounting housing; 133 is a brake housing; 134 is a turning disk; 135 is a sliding channel; 136 is a slider; 137 is a right plunger; 138 is a right cylinder; 139 is a right oil chamber; 140 is a left plunger; and 141 is a left oil chamber. In FIG. 26, 142 is a bearing of upper cover 143; 144 is a sliding bearing; 145 is a bearing of sliding channel 135; 146.1 is a left pipe; 146.2 is a right pipe; and 147 is a control valve. In FIG. 28, 148 is an electromagnetic brake; 149 is an electromagnet for brake; and 150 is an electromagnet for control valve 147.

When a voltage is applied to the electromagnet 149, the brake 148 prevents the disk 134 from turning. Therefore, no relative turning movement between the two ends of the bearing device occurs. When no voltage is applied, the brake does not act, the disk can turn freely due to external torque.

When the electromagnet 150 receives the voltage, it pushes to close the control valve 147. Thus, no oil can pass through pipes 146 and valve 147. Therefore, neither plunger 137 nor plunger 140 can move. The position of the slider 136 is fixed. When no voltage is applied, the slider 136 can be moved by external force but receive certain resistance from the control valve 147. Namely, when the valve is opened with larger orifice, less resistance will occur; when the valve is slightly opened with small orifice, heavy resistance will appear.

As described above, the brake-disk works as a turning switch. When it is allowed to turn freely, zero torsion stiffness is achieved. When no turning movement is allowed, heavy torsion stiffness will apply. The value of the stiffness is designed according to specific structures. Also, the slider works as a translational switch. When it can be moved freely, no stiffness is added to the structure. However, certain amount damping will be made by adjusting the resistance from the orifice of the control valve 147. When it is fixed, certain value of stiffness is achieved according to specific needs.

The opening of the orifice of the control valve is adjusted to achieve certain resistance. The resistance is determined in this way: 1) The slider 136 must be stopped at certain position in desired duration of time (it is allowable to take shorter time duration), otherwise the cylinder cannot be used in the next step. 2) The damping ratio of the cylinder-plunger system should be at least 70%, otherwise the energy dissipation will not be enough to drop the energy from the entire structure.

While a preferred form of this invention has been described above and shown in the accompanying drawings, it should be understood that the applicant does not intend to be limited to the particular details described above and illustrated in the accompanying drawings, but intends to be limited only to the scope of the invention as defined by the following claims.

What is claimed is:

1. A method of real-time structure parameter modification (RSM) to control the displacement of a structure comprising the following steps:

mounting functional switches in a structure, each functional switch being capable of controlling the displacement of the structure when energy is applied to the structure, and each functional switch capable of being switched between "on" and "off" states;

measuring the velocity of the structure adjacent each functional switch, which velocity is caused by the application of external energy to the structure;

establishing an initial local structural control signal for each functional switch when the measured velocity of the structure adjacent the associated functional switch approaches zero; and causing the functional switch to act in response to the initial local structural control signal in the absence of any override signal in such a manner that the functional switch will control displacement of the structure.

2. The method of controlling the displacement of a structure as set forth in claim 1 mounting the functional switches in a plurality of planes; and measuring the velocity in more than one plane.

3. The method of controlling the displacement of a structure as set forth in one of claims 1 or 2 measuring a force for each functional switch; comparing the measured force to a threshold force to see if the measured force exceeds the threshold force; and initiating an override signal if the measured force exceeds a threshold level preventing the functional switch from acting upon the initial local structural control until after a prescribed time delay, and if the force does not exceed the threshold level no override signal will be initiated and the functional switch will act in response to the initial local structural control signal.

4. The method of controlling the displacement of a structure as set forth in claim 3 measuring acceleration and structural displacement at a number of strategic locations; calculating the conservative energy of the structure using the measured value of velocity, acceleration, and displacement; determining the status of all functional switches in real-time; and issuing optimal commands to the functional switches changing their state according to the principle of minimization of conservative energy.

5. The method of controlling the displacement of a structure as set forth in claim 3 measuring acceleration and structural displacement at a number of strategic locations; calculating the conservative energy of a structure using the measured values of velocity, acceleration, and structural displacement; determining the status of all functional switches in real-time; and issuing optimal commands to the functional switches changing their state according to a velocity displacement theory.

6. The method of controlling the displacement of a structure as set forth in claim 4 determining a fail-safe setting for all functional switches that insures the stability of the structure to the extent possible without RAM; comparing the measurements of displacement, velocity, and acceleration values to certain maximum preset levels; and sending override signals to all functional switches to be in the fail-safe setting if the measurements are found to exceed maximum allowable values.

7. An apparatus for real-time structure parameter modification (RSM) whereby the displacement of a structure may be controlled; the apparatus comprising:

a plurality of functional switches (36) mounted in a structure, each functional switch being capable of controlling the displacement of the structure when energy is applied to the structure, and each functional switch capable of being switched between "on" and "off" states;

a velocity transducer (64) mounted in the structure adjacent each functional switch (36) for measuring the velocity of the structure adjacent each functional switch, which velocity is caused by the application of external energy to the structure, each velocity transducer initiating a signal in response to measured velocity;

control means (67) which establishes an initial local structural control signal for each functional switch when the associated velocity signal indicates a velocity approaching zero; and means (57) for causing the functional switch to act in response to the initial local structural control signal in the absence of any override signal in such a manner that the functional switch will control displacement of the structure.

8. The apparatus as set forth in claim 7 wherein the functional switches and velocity transducers are mounted in a plurality of planes.

9. The apparatus as set forth in claim 7 wherein a force measuring means (65) is provided, the force measuring means initiating a force signal in response to the application of a force for each functional switch, and wherein the control means is provided with comparison means to see if the measured force exceeds a threshold force, the control means being provided with means to initiate an override signal if the force exceeds the threshold level to prevent the associated functional switch from acting upon the initial local structural control signal until after a prescribed time delay, the control means not initiating the override signal if the force does not exceed the threshold level.

10. The apparatus as set forth in claim 9 wherein acceleration and displacement transducers (73) are mounted at a number of strategic locations in said structure, wherein a computer (74) is provided to calculate the conservative energy of the structure using the measured values of velocity, acceleration and structural displacement, wherein feedback lines are provided from all functional switches to the computer so that the status of the functional switches is determined in real-time, and wherein the computer issues optimal commands to the functional switches to change their state according to the principle of minimization of conservative energy.

* * * * *